US011104461B2

(12) United States Patent
Heaggans et al.

(10) Patent No.: US 11,104,461 B2
(45) Date of Patent: Aug. 31, 2021

(54) TWO-PHASE FILLING APPARATUS AND METHODS

(71) Applicant: Campbell Soup Company, Camden, NJ (US)

(72) Inventors: Samara Renee Perdue Heaggans, Roslyn, PA (US); Stewart Jon Nelson, Oldsmar, FL (US)

(73) Assignee: Campbell Soup Company, Camden, NJ (US)

( * ) Notice: Subject to any disclaimer, the term of this patent is extended or adjusted under 35 U.S.C. 154(b) by 41 days.

(21) Appl. No.: 16/131,447

(22) Filed: Sep. 14, 2018

(65) Prior Publication Data

US 2019/0084706 A1 Mar. 21, 2019

Related U.S. Application Data

(60) Provisional application No. 62/559,032, filed on Sep. 15, 2017.

(51) Int. Cl.

| | |
|---|---|
| ***B65B 37/06*** | (2006.01) |
| ***B65B 3/36*** | (2006.01) |
| ***B65B 3/12*** | (2006.01) |
| ***B65B 3/32*** | (2006.01) |

(52) U.S. Cl.

CPC ..... *B65B 37/06* (2013.01); *B65B 3/12* (2013.01); *B65B 3/32* (2013.01); *B65B 3/326* (2013.01); *B65B 3/36* (2013.01); *B65B 2220/14* (2013.01)

(58) Field of Classification Search

CPC .. B65B 37/06; B65B 3/12; B65B 3/36; B65B 2220/14; B65B 3/326; B65B 37/14; B65B 3/30; B65B 3/32; B65B 2220/01

See application file for complete search history.

(56) References Cited

U.S. PATENT DOCUMENTS

| | | | | |
|---|---|---|---|---|
| 2,850,990 | A | 9/1958 | Rasmusson | |
| 3,394,850 | A | 7/1968 | Volkober | |
| 3,550,814 | A | 12/1970 | Lersner | |
| 3,631,818 | A * | 1/1972 | Zito | A21C 9/04 99/450.1 |
| 3,702,667 | A * | 11/1972 | Pierce | B65B 3/326 222/145.1 |
| 3,799,220 | A | 3/1974 | Berry et al. | |
| 4,037,616 | A | 7/1977 | Pinkerton | |
| 4,184,613 | A * | 1/1980 | Kinney | A23G 9/282 141/105 |

(Continued)

FOREIGN PATENT DOCUMENTS

| | | |
|---|---|---|
| CN | 204433102 | 7/2015 |
| DE | 1773420 | 6/1972 |

(Continued)

*Primary Examiner* — Timothy P. Kelly
*Assistant Examiner* — Christopher M Afful
(74) *Attorney, Agent, or Firm* — Pauly, DeVries Smith & Deffner LLC

(57) ABSTRACT

Embodiments include piston filling apparatuses having first and second piston pumps in fluid communication with supply reservoirs. The first and second piston pumps can each draw in a volume of fluid and simultaneously expel a volume of fluid. Fluid expelled by the first and second piston pumps can be mixed in a manifold and allowed to flow through a filler nozzle by a filler valve. Other embodiments are also included herein.

23 Claims, 11 Drawing Sheets

(56) References Cited

U.S. PATENT DOCUMENTS

| | | | |
|---|---|---|---|
| 4,332,335 | A | 6/1982 | Fiorentini |
| 4,452,917 | A | 6/1984 | Proksa et al. |
| 4,471,887 | A | 9/1984 | Decker |
| 4,474,310 | A | 10/1984 | Mueller et al. |
| 4,676,279 | A | 6/1987 | Von Lersner |
| 4,699,297 | A | 10/1987 | Raque et al. |
| 4,823,988 | A | 4/1989 | Raque et al. |
| 4,823,992 | A | 4/1989 | Fiorentini |
| 4,995,431 | A | 2/1991 | Wakabayashi et al. |
| 5,052,591 | A | 10/1991 | Divall et al. |
| 5,088,631 | A | 2/1992 | Torterotot |
| 5,107,907 | A | 4/1992 | Marchadour |
| 5,174,472 | A | 12/1992 | Raque et al. |
| 5,270,013 | A | 12/1993 | Decker |
| 5,472,119 | A | 12/1995 | Park et al. |
| 6,158,195 | A | 12/2000 | Andersson et al. |
| 6,193,109 | B1 | 2/2001 | Credle, Jr. et al. |
| 6,863,093 | B2 | 3/2005 | Garcia et al. |
| 7,690,405 | B2 | 4/2010 | Miller et al. |
| 8,220,660 | B2 | 7/2012 | Smith |
| 8,746,295 | B2 | 6/2014 | Mueller et al. |
| 8,807,176 | B2 | 8/2014 | Hilliard, Jr. et al. |
| 8,826,948 | B2 | 9/2014 | Macquet et al. |
| 10,299,495 | B2 * | 5/2019 | Moreau ..... B65B 39/005 |
| 2010/0206903 | A1 | 8/2010 | Banco et al. |
| 2012/0261483 | A1 | 10/2012 | Elberson |

FOREIGN PATENT DOCUMENTS

| | | |
|---|---|---|
| DE | 202004020481 | 8/2005 |
| DE | 102010019872 | 11/2011 |
| EP | 0197655 | 10/1986 |
| EP | 0579467 | 1/1994 |
| EP | 0929443 | 9/2006 |
| EP | 2128080 | 12/2009 |
| GB | 1101451 | 1/1968 |
| JP | 2005047606 | 2/2005 |
| JP | 2006282280 | 10/2006 |
| WO | 9745321 | 5/1997 |
| WO | 2011120731 | 10/2011 |

* cited by examiner

TWO-PHASE FILLING APPARATUS AND METHODS

This application claims the benefit of U.S. Provisional Application No. 62/559,032, filed Sep. 15, 2017, the content of which is herein incorporated by reference in its entirety.

FIELD

Embodiments herein relate to filling containers with a fluid material. More specifically, embodiments herein relates to filling containers with a fluid food product.

BACKGROUND

Many foods and beverages are commonly filled into containers at a manufacturing plant and then distributed to stores before being purchased by consumers and ultimately consumed. There is a wide array of foods and beverages that can be filled into containers including, but not limited to, fluid products including fluid foods and beverages. Fluid products can include, but are not limited to soft drinks, dairy products, juices, soups, broths, and the like. Specialized filling equipment can be used to fill containers with fluid products such as fluid foods and beverages.

SUMMARY

Embodiments herein include a piston filling apparatus for food products that includes a first supply reservoir, a first piston pump in fluid communication with the first supply reservoir, and a first fluid supply conduit in fluid communication with the first piston pump. The first piston pump includes a piston that moves in cycle including a filling stroke where movement of the piston draws a fluid in from the first supply reservoir and an expelling stroke where movement of the piston expels the fluid into the first fluid supply conduit. The piston filling apparatus can further include a second supply reservoir, a second piston pump in fluid communication with the second supply reservoir, and a second fluid supply conduit in fluid communication with the second piston pump. The second piston pump includes a piston that moves in cycle including a filling stroke where movement of the piston draws a fluid in from the second supply reservoir and an expelling stroke where movement of the piston expels the fluid into the second fluid supply conduit.

The piston filling apparatus includes a fluid manifold in fluid communication with the first fluid supply conduit and the second fluid supply conduit, a piston valve in fluid communication with the fluid manifold, and a dispensing nozzle in fluid communication with the piston valve. The piston valve includes a piston that moves in cycle including an opening stroke where movement of the piston allows a fluid to flow in from the fluid manifold and a closing stroke where movement of the piston expels the fluid out through the dispensing nozzle. In some embodiments, the piston expels substantially all fluid beneath the piston out of the dispensing nozzle, leaving less than about 50 ml, 40 ml, 30 ml, 20 ml, 10 ml, 5 ml, 2 ml or 1 ml of fluid still in the dispensing nozzle. The piston filling apparatus includes a controller configured to control operations of the first piston pump, the second piston pump, and the piston valve. The controller can synchronize operation of the first piston pump and the second piston pump such that the expelling stroke of the first piston pump is synchronized with the expelling stroke of the second piston pump.

In an embodiment, a method for filling a container with a food product includes pumping a volume of first fluid from a first reservoir into a first conduit using a first piston pump. Pumping a volume of first fluid includes drawing a volume of first fluid from the first reservoir in an intake stroke of a first piston, and expelling a volume of first fluid into the first conduit in an exhaust stroke of the first piston. The method of filling a container includes pumping a volume of second fluid from a second reservoir into a second conduit using a second piston pump. Pumping a volume of second fluid includes drawing a volume of second fluid from the second reservoir in an intake stroke of a second piston, and expelling a volume of second fluid into the second conduit in an exhaust stroke of the second piston. The exhaust stroke of the second piston can occur in synchrony with the exhaust stroke of the first piston.

The method includes combining the first fluid with the second fluid in a manifold, where the manifold includes a fluid junction between the first supply conduit and the second supply conduit. The method further includes allowing the combined first fluid and second fluid to flow through a nozzle by opening a valve. The nozzle can provide the combined first fluid and second fluid to a container. Opening the valve occurs in synchrony with the exhaust stroke of the first piston and the exhaust stroke of the second piston.

In an embodiment, an apparatus for filling a container with a food product includes a slurry pump configured to draw a volume of slurry into a first cylinder and discharge the volume of slurry into a mixing conduit using a first piston. The apparatus also includes a water pump configured to draw a volume of water into a second cylinder and discharge the volume of water into a water feed conduit using a second piston. The apparatus includes a port in the mixing conduit downstream from the slurry pump configured to receive water from the water feed conduit.

The apparatus further includes a filler assembly downstream from the port. The filler assembly includes a chamber and a filler piston configured to allow a mixture of slurry and water from the mixing conduit into the chamber and further configured to allow a mixture of slurry and water to flow out of the chamber. The filler assembly further includes a nozzle configured to fill a container with the mixture of water and slurry from the chamber. The apparatus includes a controller configured to control operations of the slurry pump and the water pump. The controller can be configured to synchronize operation of the slurry pump and the water pump such that the discharging of the volume of slurry into the mixing conduit is synchronized with the discharging of the volume of water into the water feed conduit.

In an embodiment, a piston filling apparatus for food products includes a first fluid source, a first piston pump in fluid communication with the first fluid source, and a first fluid supply conduit in fluid communication with the first piston pump. The first piston pump includes a piston that moves in cycle including a filling stroke where movement of the piston draws a fluid in from the first fluid source and an expelling stroke where movement of the piston expels the fluid into the first fluid supply conduit. The piston filling apparatus can further include a second fluid source, a second piston pump in fluid communication with the second fluid source, and a second fluid supply conduit in fluid communication with the second piston pump. The second piston pump includes a piston that moves in cycle including a filling stroke where movement of the piston draws a fluid in from the second fluid source and an expelling stroke where movement of the piston expels the fluid into the second fluid supply conduit.

The apparatus further includes a fluid manifold in fluid communication with the first fluid supply conduit and the second fluid supply conduit. A valve is in fluid communication with the fluid manifold and a dispensing nozzle is in fluid communication with the valve. The valve comprises a piston that moves in cycle including an opening stroke where movement of the piston allows a fluid to flow in from the fluid manifold and a closing stroke where movement of the piston expels the fluid out through the dispensing nozzle. A controller can be included, the controller configured to control operations of the first piston pump, the second piston pump, and the valve. The controller can be configured to synchronize operation of the first piston pump and the second piston pump such that the expelling stroke of the first piston pump is synchronized with the expelling stroke of the second piston pump.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

In an embodiment, a filling apparatus for food products includes a first fluid source, a first fluid conduit in fluid communication with the first fluid source, a first flow meter configured to measure fluid flow through the first conduit, and a first flow cutoff mechanism disposed along the first conduit, the first flow cutoff mechanism configured to selectively allow a volume of fluid to flow through the first conduit over a first period of time. The filling apparatus for food products further includes a second fluid source, a second fluid conduit in fluid communication with the second fluid source, a second flow meter configured to measure fluid flow through the second conduit, and a second flow cutoff mechanism disposed along the second conduit, the second flow cutoff mechanism configured to selectively allow a volume of fluid to flow through the second conduit over a second period of time.

The apparatus further includes a fluid manifold in fluid communication with the first conduit and the second conduit, a valve in fluid communication with the fluid manifold, and a dispensing nozzle in fluid communication with the valve. The valve includes a piston that moves in cycle including an opening stroke where movement of the piston allows a fluid to flow in from the fluid manifold and a closing stroke where movement of the piston expels the fluid out through the dispensing nozzle. The apparatus includes controller configured to control operations of the first flow cutoff mechanism, the second flow cutoff mechanism, and the valve. The controller is configured to synchronize operations of the first flow cutoff mechanism and the second flow cutoff mechanism such that the first period of time and the second period of time occur in synchrony.

BRIEF DESCRIPTION OF THE FIGURES

Aspects may be more completely understood in connection with the following drawings, in which.

While embodiments are susceptible to various modifications and alternative forms, specifics thereof have been shown by way of example and drawings, and will be described in detail. It should be understood, however, that the scope herein is not limited to the particular embodiments described. On the contrary, the intention is to cover modifications, equivalents, and alternatives falling within the spirit and scope herein.

DETAILED DESCRIPTION

There is a wide array of foods and beverages that can be filled into containers including, but not limited to, fluid products including fluid foods and beverages. Fluid products can include, but are not limited to soft drinks, dairy products, juices, soups, broths, and the like.

Soups, in particular, are a cornerstone of diets around the world. Many soups are offered to consumers as pre-portioned volumes within a container. Current trends in the market have caused producers to offer soups in translucent containers that allow the product to be viewed by consumers before purchasing. As such, the visual appearance of the soup is an increasingly important factor.

In some manufacturing processes, a concentrated material (such as a concentrated soup material) is combined with water or another ingredient at or prior to the container-filling stage. Unfortunately, the combination of a concentrated solution with water can lead to stratification of the soup material and the water into two distinct phases within a container. A stratified soup material can be found by consumers to be visually unappealing.

However, embodiments herein can consistently combine accurate amounts of soup concentrates and diluting fluids, such as water, and fill cups with a finished soup product that, instead of existing as two phases, exists as a single phase and thus is free of discrete layers. As such, the single phase soup material filled by the systems herein have a regular and natural appearance that consumers find visually appealing.

Figure 1:
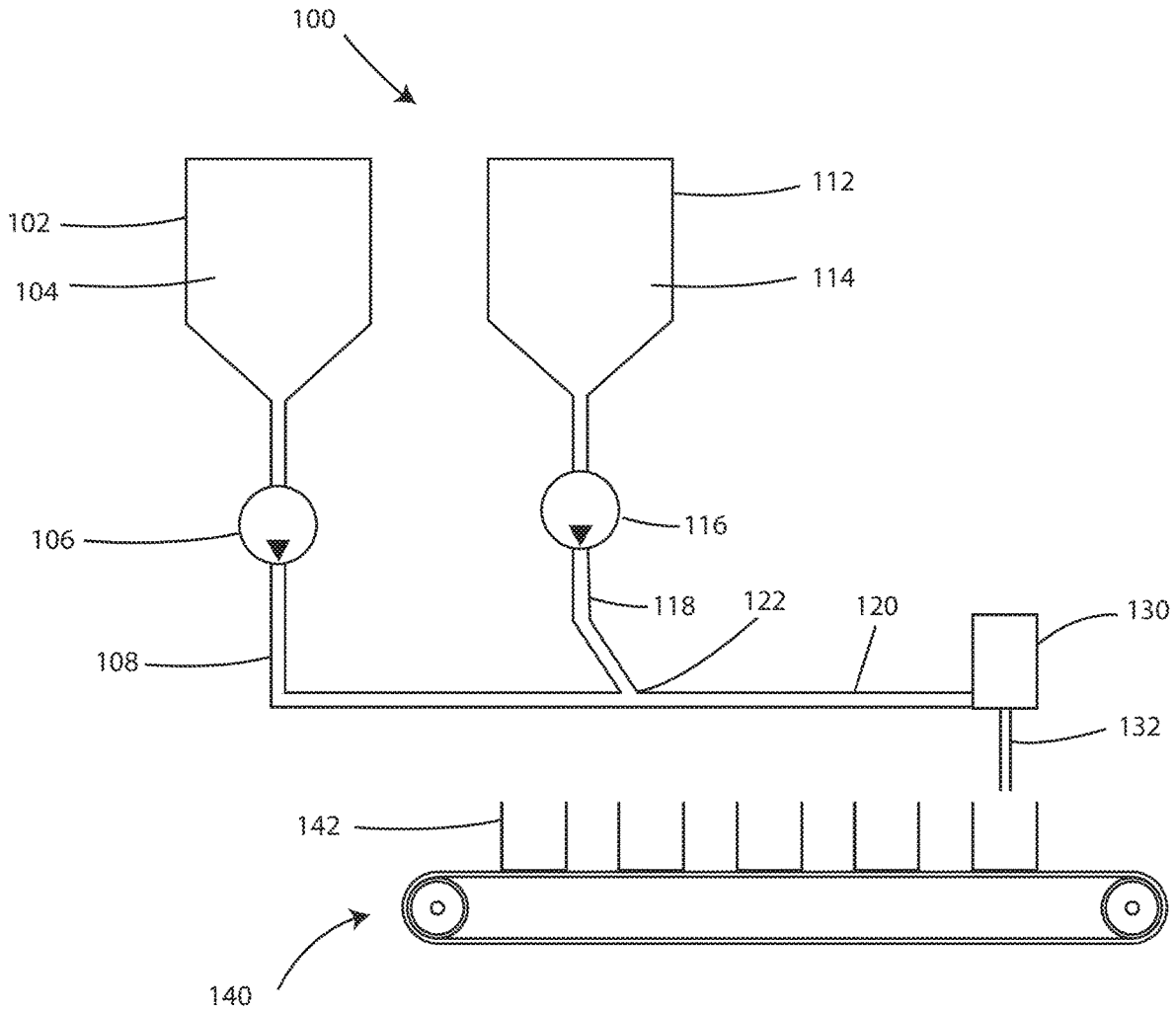
FIG. 1 is a schematic view of a filling system in accordance with various embodiments herein.

Referring now to FIG. 1, a schematic view is shown of a filling system 100 in accordance with various embodiments herein. The filling system 100 is generally used to fill containers with a mixture of multiple fluid ingredients, and in some cases solid components such as garnishes or other solids. The filling system 100 can be integrated with a production line for producing a liquid product that requires packaging. In some embodiments, the filling system 100 is configured to fill containers with a mixture of a first fluid and a second fluid. The fluid source materials mixed and filled by the filling system 100 can be various ingredients of a food material. Fluids processed by the filling system 100 can include a concentrated food material and a diluting agent. In some embodiments, the first fluid is a concentrated soup slurry and the second fluid is a less concentrated liquid such as pure water or an aqueous solution including at least some other component. As such, the second fluid can be water, flavored water, broth, or the like. Various examples of particular fluid materials will be discussed herein below.

The filling system 100 generally includes a source for each fluid material to be mixed and filled by the system. The filling system 100 includes a first reservoir 102 for providing a first fluid 104. The system 100 includes a second reservoir 112 for providing a second fluid 114. The first reservoir 102 and the second reservoir 104 can include tanks, hoppers, supply conduits, or other sources of their respective first fluid 104 and second fluid 114. Each of the first reservoir 102 and the second reservoir 112 can continuously provide a fluid having consistent material properties. One or both of the first reservoir 112 and the second reservoir 114 can include a mixing mechanism, such as a blender, auger, and the like to maintain a consistent and uniform output of fluid. Various fluid sources will be discussed further herein below.

The filling system 100 generally includes a pumping mechanism for each fluid material that is mixed and filled by the system. A pumping mechanism generally transfers fluid from a source to a downstream region. The filling system 100 includes a first pumping mechanism 106 and a second pumping mechanism 116. The first pumping mechanism 106 is in fluid communication with the first reservoir 102. The first pumping mechanism 106 is configured to pump first fluid 104 from the first reservoir 102 to a downstream region of the filling system 100. The second pumping mechanism 116 is in fluid communication with the second reservoir 112. The second pumping mechanism 116 is configured to pump second fluid 114 from the second reservoir 112 to a downstream region of the filling system 100. Each of the first pumping mechanism 106 and the second pumping mechanism 116 can include a positive displacement pump configured to pump fluid at a known volumetric flow rate, as will be described further herein below.

The filling system 100 generally includes a mixing region for combining the various ingredients. The mixing region can include a manifold that accepts fluid from the first pumping mechanism 106 and the second pumping mechanism 116. The filling system 100 can include a manifold 120 for combining the first fluid 104 and the second fluid 114. The manifold 120 is generally in fluid communication with the first pumping mechanism 106 and the second pumping mechanism 116. The manifold 120 is in fluid communication with the first pumping mechanism 106 by way of a first conduit 108. The manifold 120 is in fluid communication with the second pumping mechanism 116 by way of a second conduit 118. The first conduit 108 and the second conduit 118 can each be connected to the manifold at a port. Each port introduces fluid into the manifold 120 at a fluid junction 122 defined by the confluence of the first fluid 104 and the second fluid 114. The manifold 120 can be configured such that fully developed flow is achieved as the first fluid 104 and the second fluid 114 are pumped through the manifold 120, causing turbulent mixing of the first fluid 104 and the second fluid 114. Other aspects of manifold design will be discussed further herein below.

The filling system 100 generally includes a filler mechanism for filling containers with a combined fluid. The filling system can 100 can include a filler mechanism 130 for dispensing discrete volumes of combined fluid into containers. The filler mechanism 130 can include a mechanism for allowing, restricting, or prohibiting the flow of fluid. For example, the filler mechanism 130 can include a valve to selectively allow fluid to be dispensed into containers. The filler mechanism 130 can include a dispensing nozzle 132 for ejecting a mixture of first fluid and second fluid. The filler mechanism can include a structure for mixing or otherwise combining the first fluid 104 and the second fluid 114. Various aspects of filler design will be discussed further herein below.

The filling system 100 can include a subsystem for providing containers to the filler mechanism 130 and conveying them to downstream processes. For example, the filling system 100 can include a conveying mechanism 140. The conveying mechanism can convey one or more containers 142 into the vicinity of the filler mechanism 130. The containers 142 are generally vessels for containing the mixed liquid produced by the filling system. In some embodiments, the containers are translucent soup cups. Various aspects of conveying mechanisms and containers will be discussed further herein below.

Figure 2:
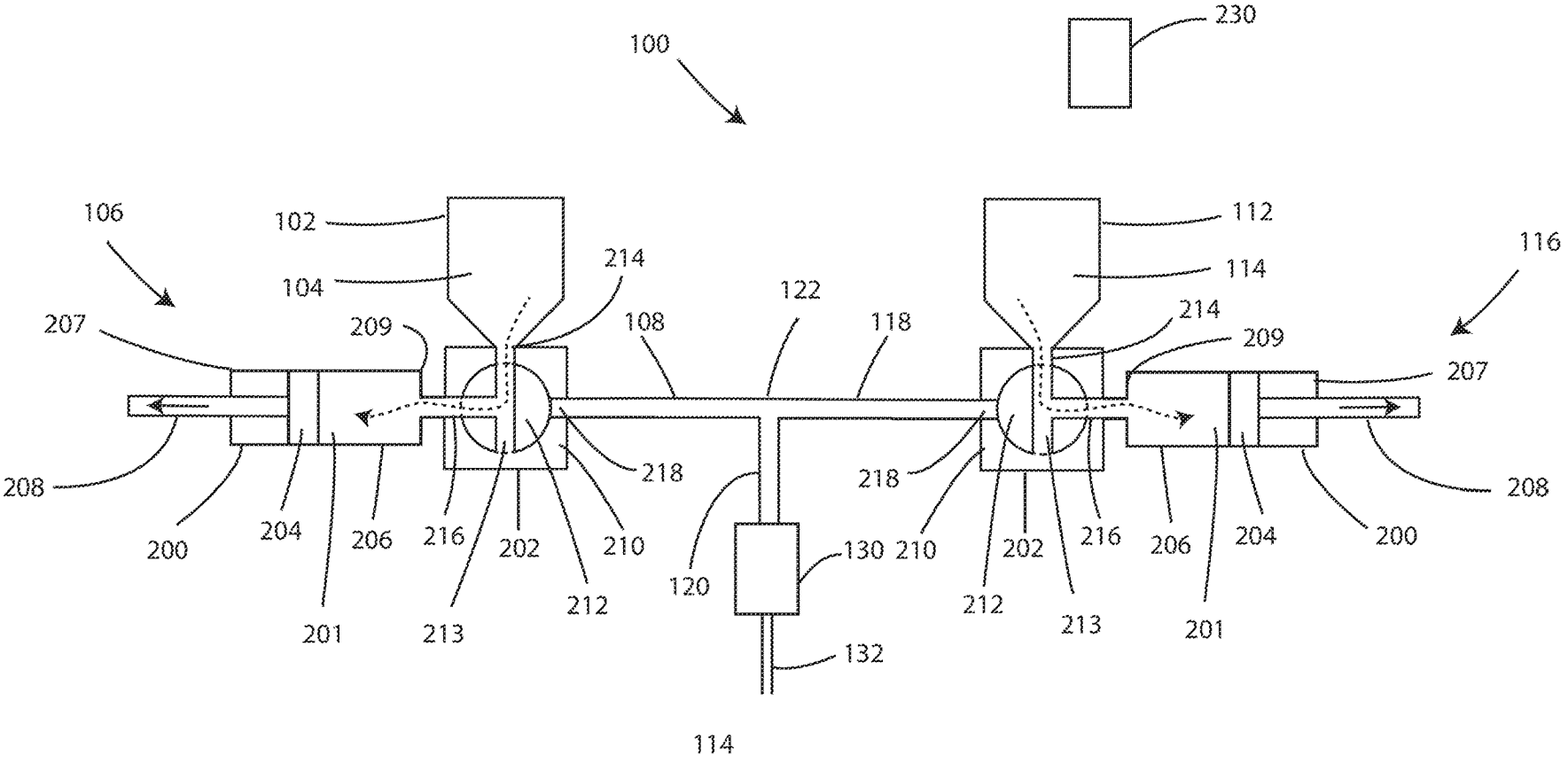
FIG. 2 is a schematic view of a filling system in a first state in accordance with various embodiments herein.
Figure 3:
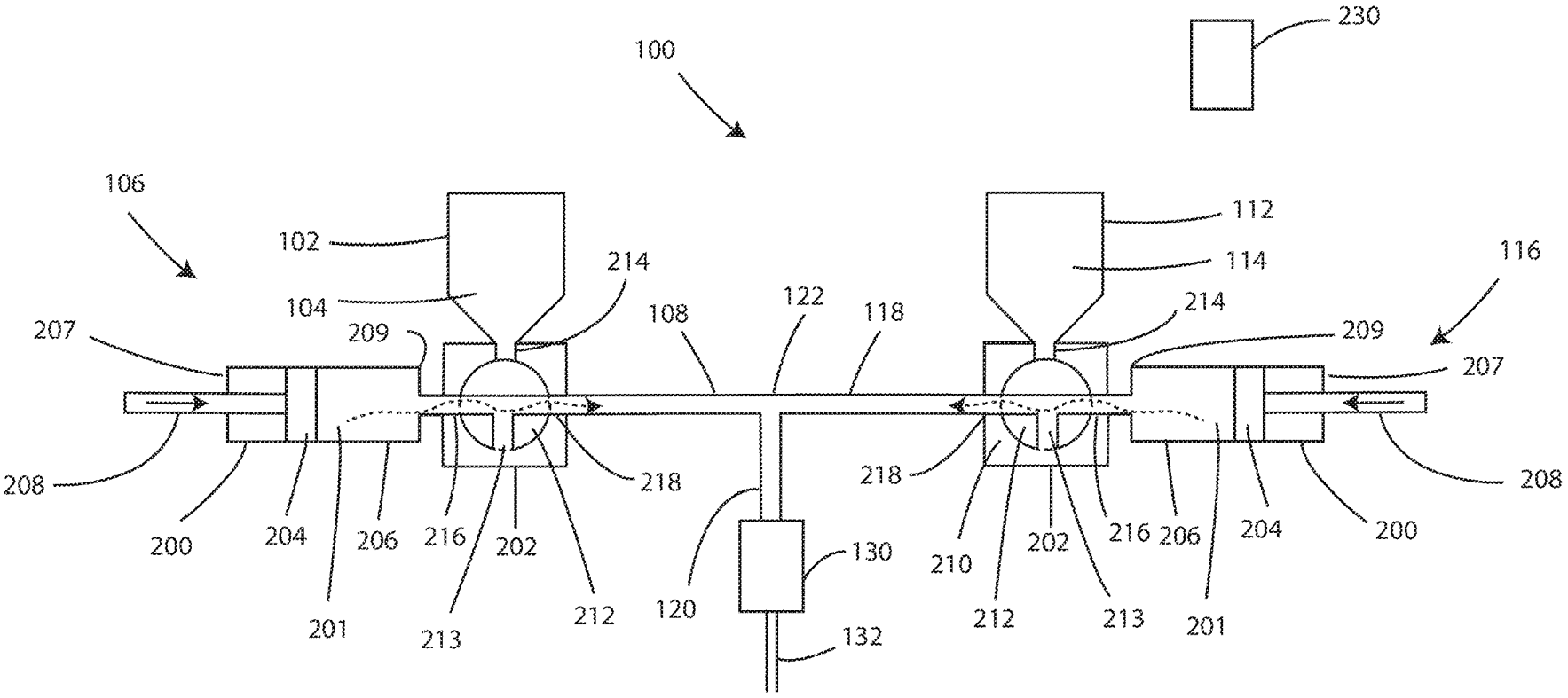
FIG. 3 is a schematic view of a filling system in a second state in accordance with various embodiments herein.

Referring now to FIGS. 2 and 3, schematic views are shown of a filling system 100 in a first state (FIG. 2) and a second state (FIG. 3). The filling systems 100 shown in FIGS. 2 and 3 lay out the details of an exemplary first pumping mechanism 106 and an exemplary second pumping mechanism 116. The first pumping mechanism 106 and the second pumping mechanism 116 each include a piston pump 200. Each piston pump is configured to aspirate a volume of fluid in an intake stroke and to discharge a volume of fluid in an exhaust stroke. A complete intake stroke followed by a complete exhaust stroke of a piston pump 200 defines a cycle of the piston pump 200. Generally, each cycle of a piston pump 200 provides a known, fixed volume of fluid. Exemplary volumes are described herein below. The first pumping mechanism 106 and the second pumping mechanism 116 each include a valve member 202. Each valve member 202 is configured to cooperatively act with the piston pumps 200 to route fluid into and out of the piston pumps 200.

Each piston pump 200 includes a piston 204, a cylinder 206, and a drive mechanism 208. Each cylinder 206 generally includes a solid body defining an inner cavity with an inner surface having inner dimensions. In some embodiments, each cylinder 206 defines an inner surface that is cylindrical. Other inner geometries are possible. In some embodiments, the inner dimension of the inner surface of a cylinder 206 is expressed as a diameter. The piston 204 of each piston pump generally defines an outer surface having outer dimensions that correspond to the inner dimensions of the cylinder. In some embodiments, the piston 204 of a piston pump 200 has an outer diameter that is about equal to the inner diameter of the cylinder 206. A piston 204 cooperatively acts with the cylinder 206 to form a fluidic seal that prevents fluid from travelling between the piston and the cylinder 206. Thus each piston 204 cooperatively forms an inner chamber 201 with each cylinder 206. Each piston 204 can move within each cylinder 206. Moving a piston 204 within a cylinder 206 changes a volume of the chamber 201 as defined by the piston 204 and the cylinder.

Each cylinder 206 has a bottom end 207 and a top end 209. A piston 204 is generally movable between a position adjacent the bottom end 207 and a position adjacent the top end 209. In some embodiments, the cylinder 206 has a stopping structure near the top end 209 to limit motion of the piston towards the top end 209. In some embodiments, the cylinder 206 has a stopping structure near the bottom end 207 to limit motion of the piston 204 toward the bottom end 207. In some embodiments, the drive mechanism 208 provides the travel-limiting functionality, as will be described further herein below. An intake motion of the piston pump 200 can be defined as the motion of the piston 204 in a direction towards the bottom end 207 of the cylinder 206. An exhaust motion of the piston pump 200 can be defined as the motion of the piston 204 in a direction towards the top end 209 of the cylinder 206. An intake stroke of the piston pump 200 can be defined as the motion of the piston 204 from an extreme position adjacent the top end 209 of the cylinder 206 to an extreme position adjacent the bottom end 207 of the cylinder 206. An exhaust stroke of the piston pump 200 can be defined as the motion of the piston 204 from an extreme position adjacent the bottom end 207 of the cylinder to an extreme position adjacent the top end 209 of the cylinder 206. The displacement of a piston pump 200 can be defined as the difference between the volume of the chamber 201 when the piston 204 is at an extreme position adjacent the bottom end 207 of the cylinder 206 and the volume of the chamber 201 when the piston 204 is at an extreme position adjacent the top end 209 of the cylinder 206.

The piston 204 of a piston pump 200 is driven by a drive mechanism 208. A drive mechanism generally includes a power source and a structure for transmitting power to the piston 204. In some embodiments, the drive mechanism includes linear actuator. A linear actuator can transmit power to a piston 204 through a push rod or other mechanical linkage. Linear actuators can include hydraulic actuators, pneumatic actuators, electric actuators, and the like. In some embodiments, the drive mechanism includes a power source that provides rotational motion. In some embodiments, the drive mechanism includes a servo motor. In some such embodiments, a drive motor can be in mechanical communication with a piston 204 by way of a linkage including elements such as a crankshaft and connecting rod. In some embodiments, the drive mechanism 208 includes a structure for limiting the travel of the piston 204. For example, a linear actuator in the drive mechanism 208 can have a limited linear range of motion that gives the piston 204 a corresponding limited range of motion. In some embodiments, the drive mechanism can provide an adjustable range of motion, as will be described further herein below. Various piston pumps are described in U.S. Pat. No. 4,699,297, which is herein incorporated by reference in its entirety.

Each piston pump 200 includes a port 205 for fluid to travel into and out of the piston pump. A port 205 is generally located toward the top end 209 of a cylinder 206 such that the piston 204 does not obstruct flow into or out of the port 205 at any point in its stroke. As a piston 204 moves in an intake stroke within a cylinder 206, the volume the chamber 201 is increased and fluid is drawn into the chamber through the port 205. Conversely, as a piston 204 moves in an exhaust stroke within a cylinder 206, the volume of the chamber 201 is decreased and fluid is discharged from the chamber through the port 205. FIG. 2 illustrates a first pumping mechanism 106 and a second pumping mechanism 116 with piston pumps 200 each undergoing an intake stroke. FIG. 3 illustrates a first pumping mechanism 106 and a second pumping mechanism 116 with piston pumps 200 each undergoing an exhaust stroke.

The valve members 202 of each of the first and second pumping mechanism 106 and 116 are used to control the flow of fluid into and out of the piston pumps 200. The valve members 202 generally put the chamber 201 of each piston pump 200 in fluid communication with their respective first reservoir 102 or second reservoir 112 during an intake stroke. The valve members 202 generally put the chamber 201 of each piston pump 200 in fluid communication with the respective first conduit 108 and second conduit 118 during an exhaust stroke. The valve members 202 in combination with the piston pumps 200 allow for accurate and repeatable volumes of fluid to be pumped by each piston pump 200. Various valves are possible that allow a piston pump to have the desired functionality.

In some embodiments, the valve members 202 include rotary valves. Exemplary rotary valves configured for use with piston pumps are described in U.S. Pat. No. 4,823,988 which is herein incorporated by reference in its entirety. The valve members 202 each include a valve body 210 and a rotor 212. The rotor 212 can be rotationally moved with reference to the valve body 210. The rotor 212 can be moved to discrete positions within the valve body corresponding to different configurations. The different valve configurations can correspond to different pumping states, such as intake and exhaust. The rotor 212 includes a channel 213 for the passage of fluid. Different positions of the rotor 212 are used to put the channel 213 in communication with different ports on the valve body 210. The valve body includes a first port 214, a second port 216, and a third port 218. The first port 214 is in fluid communication with a fluid source, such as the first reservoir 102 or the second reservoir 112. The second port 216 is in fluid communication with the inlet 205 of a piston pump 200. The third port 218 is in fluid communication with a downstream region of the filling system, such as the first conduit 108 or the second conduit 118. The first port 214, the second port 216, and the third port 218 can be selectively put in communication with the channel 213 by selectively positioning the rotor 212 in a discrete position.

In an intake configuration, as depicted in FIG. 2, the rotary valve is configured such that the chamber 201 of each piston pump 200 is in communication with a respective reservoir. Specifically, the chamber 201 of the first pumping mechanism 106 is in communication with the first reservoir 102 and the chamber 201 of the second pumping mechanism 116 is in communication with the second reservoir 112. In this intake configuration, the rotor is in a position that puts the channel 213 in communication with the first port 214 and the second port 216. As such, fluid can flow from each reservoir to each chamber 201 by way of the first port 214, the channel 213, and the second port 216 of each rotary valve 202 as each piston 204 is moved toward the bottom end 207 of each cylinder 206. Fluid from each reservoir is thus drawn into each cylinder 206.

In an exhaust configuration, as depicted in FIG. 3, the rotary valve is configured such that the chamber 201 of each piston pump 200 is in communication with a fluid conduit. Specifically, the chamber 201 of the first pumping mechanism 106 is in communication with the first conduit 108 and the chamber 201 of the second pumping mechanism 116 is in communication with the second conduit 118. In this exhaust configuration, the rotor is in a position that puts the channel 213 in communication with the second port 216 and the third port 218. As such, fluid can flow from each chamber 201 to the each conduit by way of the second port 216, the channel 213, and the third port 218 of each rotary valve 202 as each piston 204 is moved toward the top end 209 of each cylinder 206. Fluid from each reservoir is thus discharged from each cylinder 206 and expelled into the respective first conduit 108 and second conduit 118.

The rotor 212 of each valve member can be driven by a valve actuator. A valve actuator can include an electrical, mechanical, hydraulic, pneumatic, or other mechanism for driving the rotation of a rotor 212. The configuration of a valve member 202 must be timed to match the configuration of a corresponding piston pump 200 in communication with the valve member 202. In some embodiments, the actuator of each valve member 202 is in mechanical communication with each piston pump. In some embodiments, the actuator of each valve member 202 is in electrical communication with each piston pump. The coordination between a piston pump 200 and a corresponding valve member 202 is generally performed by a controller 230. The controller can include any mechanical, electrical, or other components that effect valve actuation. In some embodiments, the controller 230 includes a closed-loop system that actuates each valve member 202 in response to a position of a corresponding piston pump 200. In some embodiments, the controller 230 incorporates an open-loop system that actuates each valve member 202 in response to an estimated position of a corresponding piston pump 200.

Other types of valve members are also contemplated herein that can provide a desired control of fluid flow into and out of piston pumps. For example, in some embodiments, the valve members 202 include one or more one-way check valves. Valve members 202 having check valves allow fluid to be drawn into the chamber 201 of each piston pump 200 during an intake stroke. For example, a first check valve can be disposed between a fluid reservoir and the chamber of a piston pump to allow for the one-way flow of fluid from the reservoir into the chamber during the intake stroke. Valve members 202 having check valves allow fluid to be expelled from the chamber 201 of each piston pump 200 during an exhaust stroke. For example, a second check valve can be disposed between the chamber of a piston pump and a fluid conduit to allow the flow of fluid from the chamber into the conduit during an exhaust stroke. Other types of valves can include linear motion valves, rotary motion valves, gate valves, globe valves, ball valves, plug valves, diaphragm valves, pinch valves, butterfly valves, and the like.

The relative rate and phase of the first pumping mechanism and the second pumping mechanism can influence the properties of the product filled by the filling system 100. As such, the timing and rates of the intake and exhaust strokes of each piston pump 200 can be configured to provide a desired product. In some embodiments, the first pumping mechanism 106 can operate in phase with the second pumping mechanism 116, such that each cycle of the piston pump 200 the first pumping mechanism 106 occurs in synchrony with each cycle of the piston pump 200 of the second pumping mechanism 116. In some embodiments, the intake stroke of the piston pump 200 of the first pumping mechanism 106 occurs in synchrony with the intake stroke of the piston pump 200 of the second pumping mechanism 116. In such embodiments, the piston 204 of the first pumping mechanism 106 and the piston 204 of the second pumping mechanism 116 each begin an intake stroke simultaneously and each end an intake stroke simultaneously. In some embodiments, the exhaust stroke of the piston pump 200 of the first pumping mechanism 106 occurs in synchrony with the exhaust stroke of the piston pump 200 of the second pumping mechanism 116. In such embodiments, the piston 204 of the first pumping mechanism 106 and the piston 204 of the second pumping mechanism 116 each begin an exhaust stroke simultaneously and each end an exhaust stroke simultaneously.

While not intending to be bound by theory, in some cases the simultaneous action of a first piston pump and a second piston pump has been found to be important to the creation of a single phase food product instead of a food product containing two or more distinct phases. In some embodiments, a simultaneous action of a first piston pump and a second pump occurs such that the action of the first piston pump occurs within a certain time of the action of the second piston pump, wherein the time is: under 0.5 seconds, under 0.3 seconds, under 0.2 seconds, under 0.1 seconds, under 0.05 seconds, under 0.01 seconds, or about 0 seconds. In some embodiments, the synchronous operation of a first piston pump and a second piston pump occurs such that the first piston pump and the second piston pump operate within a certain phase offset from each other, wherein the phase offset is: under 0.75 radians, under 0.5 radians, under 0.25 radians, under 0.1 radians, under 0.05 radians, under 0.01 radians, and about 0 radians.

The controller 230 can be used to control the operation of the first pumping mechanism 106 and the second pumping mechanism 116. The controller 230 can cause the first pumping mechanism 106 and the second pumping mechanism 116 to operate in synchrony, as described above. The controller 230 can be in mechanical, electrical, or other communication with the drive mechanism 208 of each piston pump 200 of each pumping mechanism 106. In some embodiments, the controller 230 includes a closed-loop system that controls each piston pump 200 with reference to the position or phase of each other piston pump. In some embodiments, the controller 230 incorporates an open-loop system that controls each piston pump 200 based on time. Various aspects of the controller 230 will be described further herein below.

When the first pumping mechanism 106 and the second pumping mechanism 116 operate in phase, a volume of first fluid 104 is delivered to the manifold 120 simultaneously with a volume of second fluid. As the first fluid 104 pumped by the first pumping mechanism 106 is delivered to the manifold 120, it is combined with the second fluid 114 pumped by the second pumping mechanism 116 as is delivered to the manifold 120. Various degrees of fluid mixing can occur in the manifold, and various aspects of the manifold will be described further herein. The combined first fluid and second fluid of the manifold 120 is delivered to the filler mechanism 130. The filler mechanism 130 generally controls the flow of fluid exiting the system 100. The filler mechanism 130 includes a nozzle 132 for directing an exiting stream of fluid into a container or other vessel.

Figure 4:
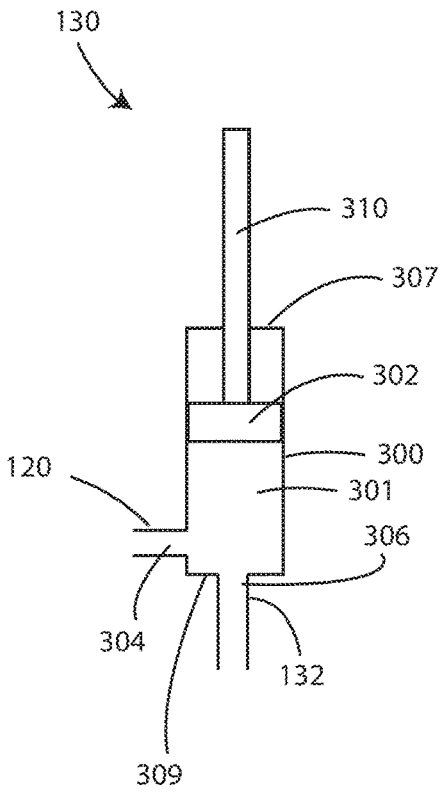
FIG. 4 is a schematic cross-sectional view of a filler mechanism in accordance with various embodiments herein.

Referring now to FIG. 4, a schematic cross-sectional view of a filler mechanism 130 is shown. The filler mechanism 130 is a positive-displacement pumping mechanism. The filler mechanism 130 is configured as a piston pump. The filler mechanism 130 includes a piston 304, a cylinder 306, and a drive mechanism 308. The cylinder 306 generally defines a solid body defining an inner cavity with an inner surface having inner dimensions. In some embodiments, the cylinder 306 defines an inner surface that is cylindrical. Other inner geometries are possible. The piston 304 generally defines an outer surface having outer dimensions that correspond to the inner dimensions of the cylinder. In some embodiments, the piston 304 has an outer diameter that is about equal to the inner diameter of the cylinder 306. The piston 304 cooperatively acts with the cylinder 306 to form a fluidic seal that prevents fluid from travelling between the piston and the cylinder 306. Thus the piston 304 cooperatively forms an inner chamber 301 with the cylinder 306. The piston 304 can move within the cylinder 306. Moving the piston 304 within the cylinder 306 changes the volume of the chamber 301 as defined by the piston 304 and the cylinder 306.

The cylinder 306 has a bottom end 307 and a top end 309. The piston 304 is generally movable between a position adjacent the bottom end 307 and a position adjacent the top end 309. In some embodiments, the cylinder 306 has a stopping structure near the top end 309 to limit motion of the piston towards the top end 309. In some embodiments, the cylinder 306 has a stopping structure near the bottom end 307 to limit motion of the piston 304 toward the bottom end 307. In some embodiments, the drive mechanism 308 provides the travel-limiting functionality, as will be described further herein below. A filling motion of the filler mechanism 130 can be defined as the motion of the piston 304 in a direction towards the bottom end 307 of the cylinder 306. An expelling motion of the filler mechanism 130 can be defined as the motion of the piston 304 in a direction towards the top end 309 of the cylinder 306. A filling stroke of the filler mechanism 130 can be defined as the motion of the piston 304 from an extreme position adjacent the top end 309 of the cylinder 306 to an extreme position adjacent the bottom end 307 of the cylinder 306. An expelling stroke of the filler mechanism 130 can be defined as the motion of the piston 304 from an extreme position adjacent the bottom end 307 of the cylinder to an extreme position adjacent the top end 309 of the cylinder 306. The displacement of a filler mechanism 130 can be defined as the difference between the volume of the chamber 301 when the piston 304 is at an extreme position adjacent the bottom end 307 of the cylinder 306 and the volume of the chamber 301 when the piston 304 is at an extreme position adjacent the top end 309 of the cylinder 306. The displacement of the piston-pump-type filler mechanism 130 can be equal to the displacement of all upstream pumping mechanisms. A complete filling stroke followed by a complete expelling stroke of a filler mechanism 130 defines a cycle of the filler mechanism 130. Generally, each cycle of a filler mechanism 130 provides a known, fixed volume of fluid.

The piston 304 of a filler mechanism 130 is driven by a drive mechanism 308. A drive mechanism generally includes a power source and a structure for transmitting power to the piston 304. In some embodiments, the drive mechanism includes linear actuator. A linear actuator can transmit power to a piston 304 through a push rod or other mechanical linkage. Linear actuators can include hydraulic actuators, pneumatic actuators, electric actuators, and the like. In some embodiments, the drive mechanism includes a power source that provides rotational motion. In some such embodiments, a drive motor can be in mechanical communication with a piston 304 by way of a linkage including elements such as a crankshaft and connecting rod. In some embodiments, the drive mechanism 308 includes a structure for limiting the travel of the piston 304. For example, a linear actuator in the drive mechanism 308 can have a limited linear range of motion that gives the piston 304 a corresponding limited range of motion. In some embodiments, the drive mechanism can provide an adjustable range of motion, as will be described further herein below.

The filler mechanism 130 includes an inlet port 304 and an outlet port 306. The inlet port 304 is in fluid communication with a manifold 120. The inlet port 304 is configured to receive fluid from the manifold 120. As the piston 304 moves in a filling stroke within the cylinder 306, the volume the chamber 301 increased and fluid is drawn into the chamber through the inlet port 304. The outlet port 306 is in fluid communication with a nozzle 132. The outlet port is configured to provide fluid to the nozzle 132. As the piston 304 moves in an expelling stroke within the cylinder 306, the volume of the chamber 301 is decreased and fluid is discharged from the chamber 301 through the outlet port 306.

In some embodiments, the filler mechanism 130 is configured to operate in synchrony with one or both pumping mechanisms of a filler system. Synchronous operation of the filler mechanism 130 and an upstream pumping mechanism can include cycles of the filler mechanism 130 occurring at the same rate as cycles of the first and/or second pumping mechanisms 106 and 116. The synchronous operation of the filler mechanism 130 and an upstream pumping mechanism can include the piston 304 of the filler mechanism 130 operating in phase with the piston of the upstream pumping mechanism, or at a phase offset from the piston of the upstream pumping mechanism. In some embodiments, the filler mechanism 130 operates at a phase offset such that the filling stroke of the filler mechanism 130 occurs in synchrony with the exhaust stroke of one or more upstream pumping mechanisms. In some embodiments, a filling stroke of the filler mechanism 130 occurs in synchrony with the exhaust stroke of a first and second upstream pumping mechanisms. In such embodiments, the filling mechanism 130 can draw a volume of combine fluid that is equal to the cumulative volume of fluid discharged by the upstream pumping mechanisms. The timing of the filling mechanism 130 can be controlled by a controller. In some embodiments, a controller configured to control the operations of the filling mechanism 130, a first piston pump, and a third piston pump.

Figure 5:
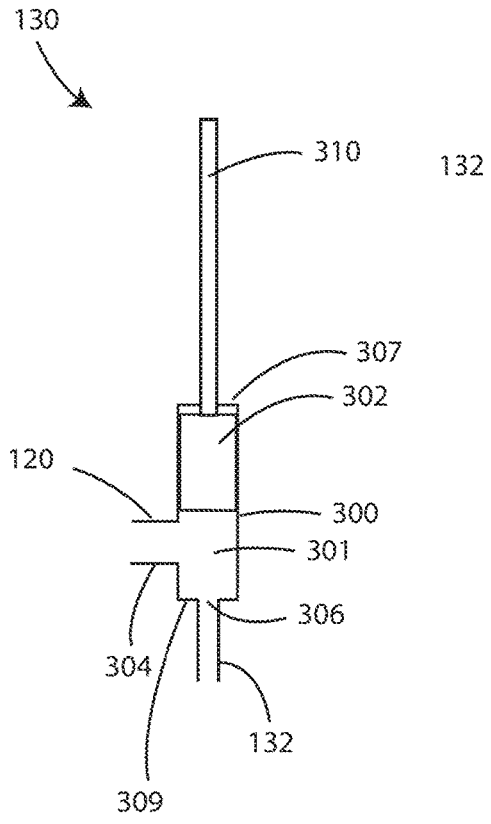
FIG. 5 is a schematic cross-sectional view of a filler mechanism in accordance with various embodiments herein.

Referring now to FIG. 5, a schematic cross-sectional view of a filler mechanism 130 is shown. The filler mechanism 130 is configured as a piston valve. The piston valve includes a piston 304, a cylinder 306, and a drive mechanism 308. The piston 304, cylinder 306, and drive mechanism 308 can be generally consistent with those of the filler mechanism 130 depicted in FIG. 4. The piston 304 can be any shuttle structure configured to allow, restrict, or prohibit fluid communication between the manifold 120, a chamber 301, and a filler nozzle 132. A piston valve is not limited to cylindrical pistons and cylinder, but can include other geometries. Unlike certain filler mechanisms described with reference to FIG. 4, the chamber 301 cooperatively formed by the piston 304 and the cylinder 306 in a piston valve configuration has a volume that is smaller than the volume of fluid to be filled in a container.

The filler mechanism 130 includes an inlet port 304 and an outlet port 306. The inlet port 304 is in fluid communication with a manifold 120. The inlet port 304 is configured to receive fluid from the manifold 120. The outlet port 306 is in fluid communication with a nozzle 132. The outlet port is configured to provide fluid to the nozzle 132. The cylinder 306 has a bottom end 307 and a top end 309. The piston 304 is generally movable between a position adjacent the bottom end 307 and a position adjacent the top end 309. At a position adjacent the top end 309, the filler mechanism is in a closed configuration. In such a closed configuration, the piston 302 obstructs one or both of the inlet port 304 and an outlet port 306. By obstructing one or both of the inlet port 304 and the inlet port 306, the piston 304 prohibits fluid from flowing through the filler mechanism 130. At a position adjacent the bottom end 307, the filler mechanism is in an open configuration. In such an open configuration, the piston 302 does not obstruct the inlet port 304 or the outlet port 306. In an open configuration, fluid flow is generally allowed through the filler mechanism 130. In an open configuration, fluid is allowed to flow from the manifold 120 into the chamber 301, and further allowed to flow from the chamber 301 into the nozzle 132.

An opening motion of the filler mechanism 130 can be defined as the motion of the piston 304 in a direction towards the bottom end 307 of the cylinder 306. A closing motion of the filler mechanism 130 can be defined as the motion of the piston 304 in a direction towards the top end 309 of the cylinder 306. An opening stroke of the filler mechanism 130 can be defined as the motion of the piston 304 from an extreme position adjacent the top end 309 of the cylinder 306 to an extreme position adjacent the bottom end 307 of the cylinder 306. A closing stroke of the filler mechanism 130 can be defined as the motion of the piston 304 from an extreme position adjacent the bottom end 307 of the cylinder to an extreme position adjacent the top end 309 of the cylinder 306. The displacement of a filler mechanism 130 can be defined as the difference between the volume of the chamber 301 when the piston 304 is at an extreme position adjacent the bottom end 307 of the cylinder 306 and the volume of the chamber 301 when the piston 304 is at an extreme position adjacent the top end 309 of the cylinder 306. The displacement of the piston-valve-type filler mechanism 130 can be less than the displacement of all upstream pumping mechanisms. A complete opening stroke followed by a complete closing stroke of a filler mechanism 130 defines a cycle of the filler mechanism 130. Generally, each cycle of a filler mechanism 130 allows a known, fixed volume of fluid to flow through the filler and be dispensed by a nozzle 132.

In some embodiments, the filler mechanism 130 is configured to operate in synchrony with one or both pumping mechanisms of a filler system. Synchronous operation of the filler mechanism 130 and an upstream pumping mechanism can include cycles of the filler mechanism 130 occurring at the same rate as cycles of the first and/or second pumping mechanisms 106 and 116. The synchronous operation of the filler mechanism 130 and an upstream pumping mechanism can include the piston 304 of the filler mechanism 130 operating in phase with the piston of the upstream pumping mechanism, or at a phase offset from the piston of the upstream pumping mechanism. In some embodiments, the filler mechanism 130 operates at a phase offset such that the opening stroke of the filler mechanism 130 occurs in synchrony with the exhaust stroke of one or more upstream pumping mechanisms.

Figure 6:
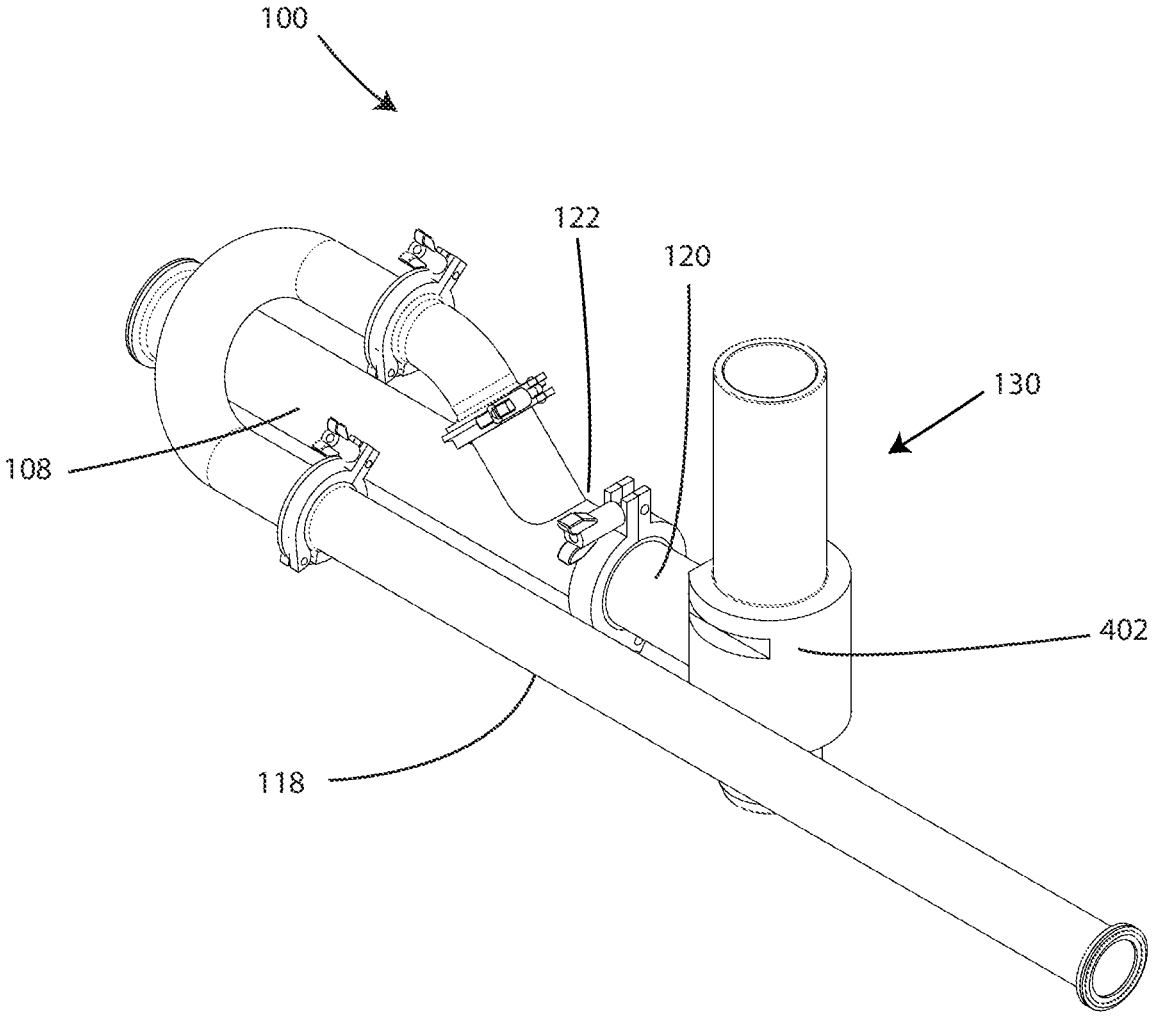
FIG. 6 is a partial perspective view of a filling system in accordance with various embodiments herein.

Referring now to FIG. 6, a partial perspective view is shown of a filling system 100 in accordance with various embodiments herein. FIG. 6 depicts the filler mechanism environment of a filling system. A first conduit 108 is shown leading to a filler mechanism 130. A second conduit 118 is shown leading to a port 122 of the first conduit 108. The port 122 is a region where the second conduit 118 merges into the first conduit 108. A manifold 120 is a region of the first conduit 108 located downstream of the port 122. The manifold 120 is a length of the first conduit in which fluid from the first conduit 108 and fluid from the second conduit 118 are combined and mixed. In some embodiments, the length and diameter of the manifold 120 are configured such that turbulent flow is achieved in the manifold 120. The manifold 120 is coupled to a filler body 402, where a combined fluid is provided to the filler mechanism 130.

Figure 7:
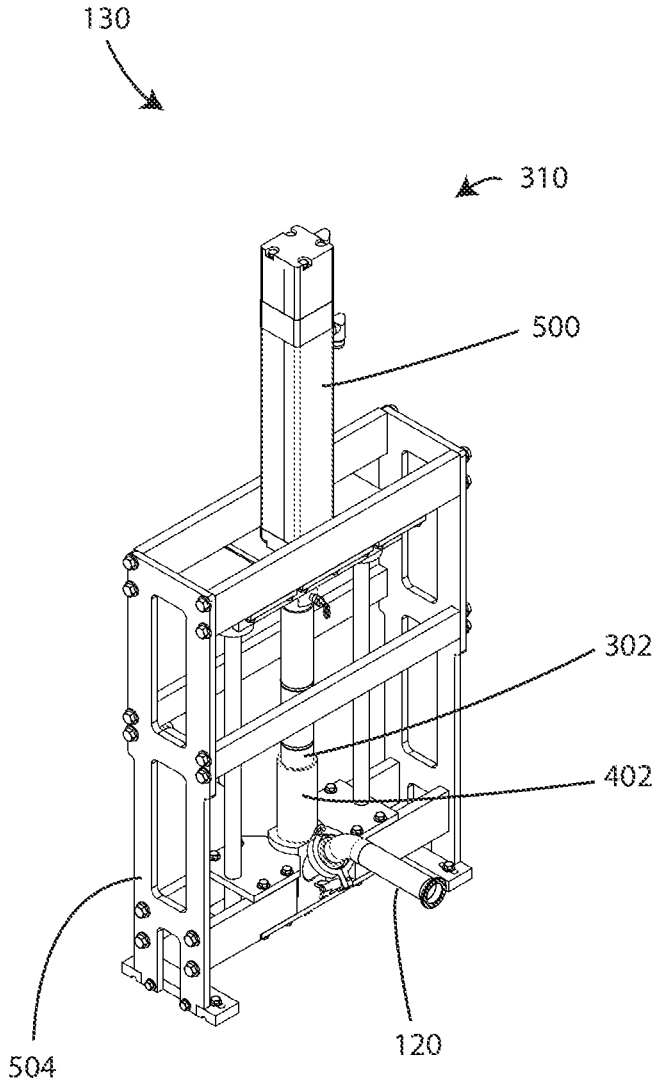
FIG. 7 is a perspective view of a filler mechanism in accordance with various embodiments herein.

Referring now to FIG. 7, a perspective view of a filler mechanism 130 is shown in accordance with various embodiments herein the filler mechanism 130 can have a frame 504. The frame 504 supports the filler body 402 and a filler drive mechanism 310. The filler drive mechanism is configured to drive a piston 302. The drive mechanism 310 includes a linear actuator 500. In some embodiments, the linear actuator 500 is electric. In some embodiments, the linear actuator 500 is pneumatic. In some embodiments, the linear actuator 500 is hydraulic. Other linear actuators types are possible. The frame 504 can be configured to span a conveying mechanism 140. The conveying mechanism 140 can convey containers through the filling mechanism 130. As a container is passed through the filling mechanism 130, it is filled by the filling mechanism 130.

Figure 8:
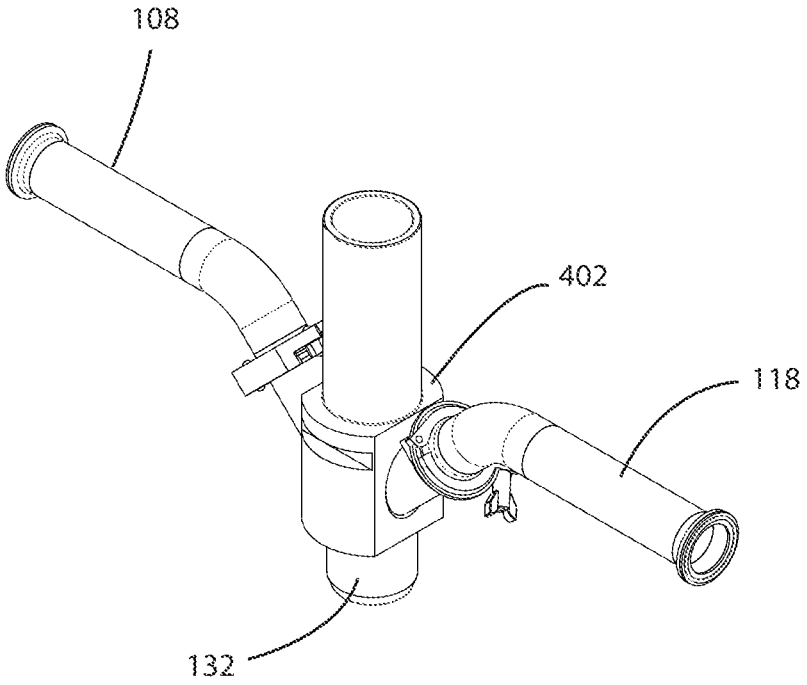
FIG. 8 is a partial perspective view of a filling system in accordance with various embodiments herein.
Figure 9:
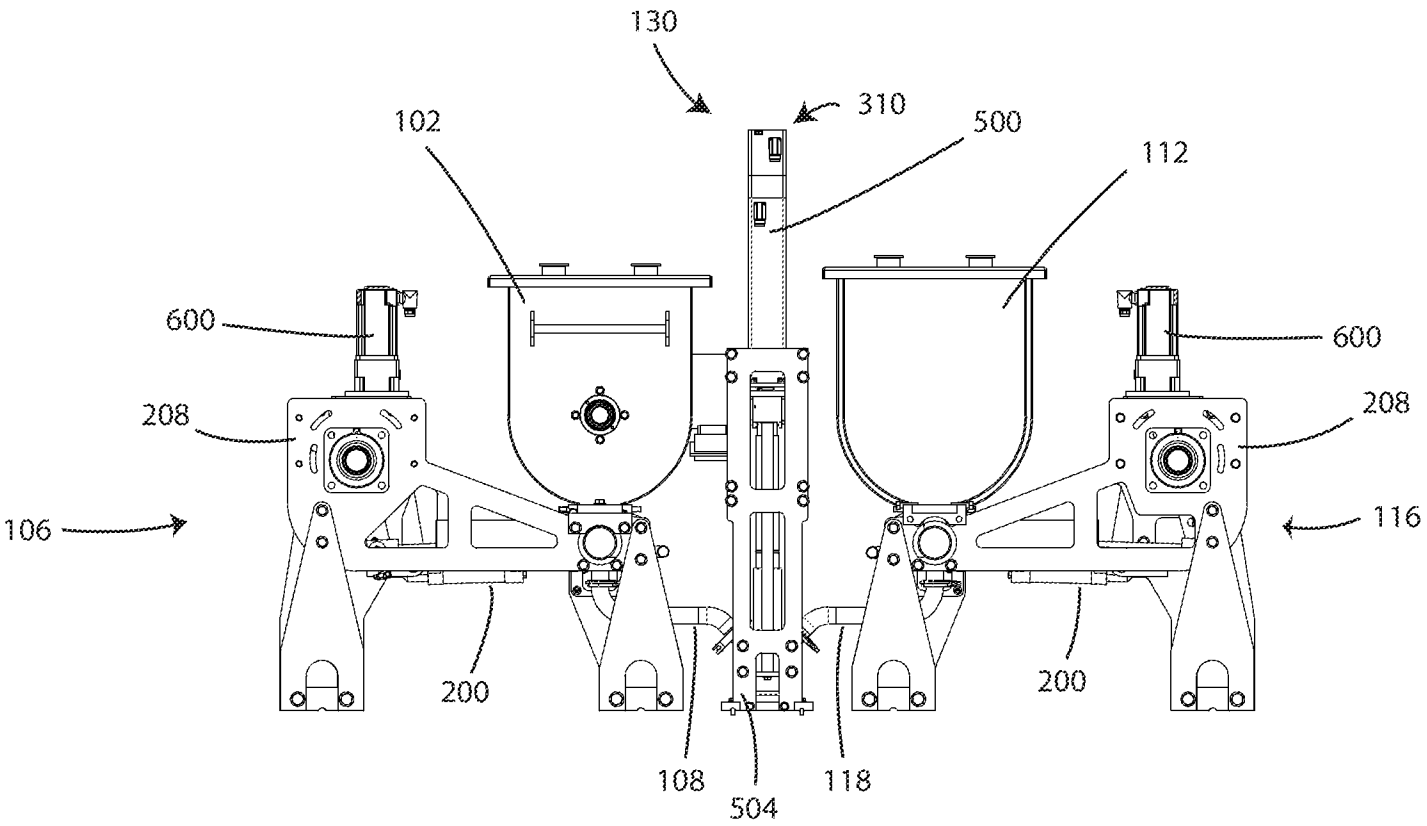
FIG. 9 is a side view of a filling system in accordance with various embodiments herein.

Referring now to FIG. 8, a partial perspective view is shown of an alternative filling system 100 in accordance with various embodiments herein. FIG. 9 depicts the filler mechanism environment of a filling system. A first conduit 108 is shown leading to a filler body 402 of a filler mechanism 130. A second conduit 118 is shown leading to the filler body 402 of the filler mechanism 130. The filler mechanism 130 can be consistent with the various filler mechanisms described herein. The filler body 402 includes a plurality of ports 122 for receiving the first conduit 108 and the second conduit 118. Each port leads into a mixing chamber of the filler mechanism 130. Fluid enters the chamber from the ports and can be mixed in the chamber. The chamber acts as a manifold for combining fluid from the first conduit 108 and the second conduit 118. From the chamber, the combined fluid can be drawn into a cylinder 306 of the filler mechanism by a piston (not shown) and subsequently expelled from the cylinder 306.

Referring now to FIG. 9, a side view is shown of a filling system 100 in accordance with various embodiments herein. The filling system 100 can be generally consistent with the various filling systems described herein. The filling system 100 has a first reservoir 102 and a second reservoir 112. A first pumping mechanism 106 is provided to pump a first fluid from the first reservoir 102 into a first conduit 108. A second pumping mechanism 116 is provided to pump a second fluid from the second reservoir 112 into a second conduit 118. The first conduit 108 and the second conduit 118 are in communication with a filler mechanism 130, and provide pumped fluid thereto. The filler mechanism 130 can be consistent with the various filler mechanisms described herein. The filler mechanism 130 includes a frame 504 and a drive mechanism 310 including a linear actuator 500.

Each of the first pumping mechanism 106 and the second pumping mechanism 116 includes a drive mechanism 208. Each drive mechanism can include a drive motor 600. Each drive mechanism 208 can include a linkage (not shown) for transmitting rotational motion from each drive motor 600 to a pump. In some embodiments, the drive mechanism 208 of a pumping mechanism drives both a pump and a valve member. In some embodiments, a drive mechanism 208 converts rotational motion from a drive motor 600 to reciprocating motion of a piston pump. In some embodiments, a drive mechanism converts rotational motion from a drive motor 600 to reciprocal rotation of a rotary valve. In some embodiments, the linkage of a drive mechanism 208 is adjustable, and can provide a selectable stroke to a piston pump of a pumping mechanism. The drive mechanisms 208 can be consistent with the various drive mechanisms described herein.

Parallel Fillers and Additional Phases

Figure 10:
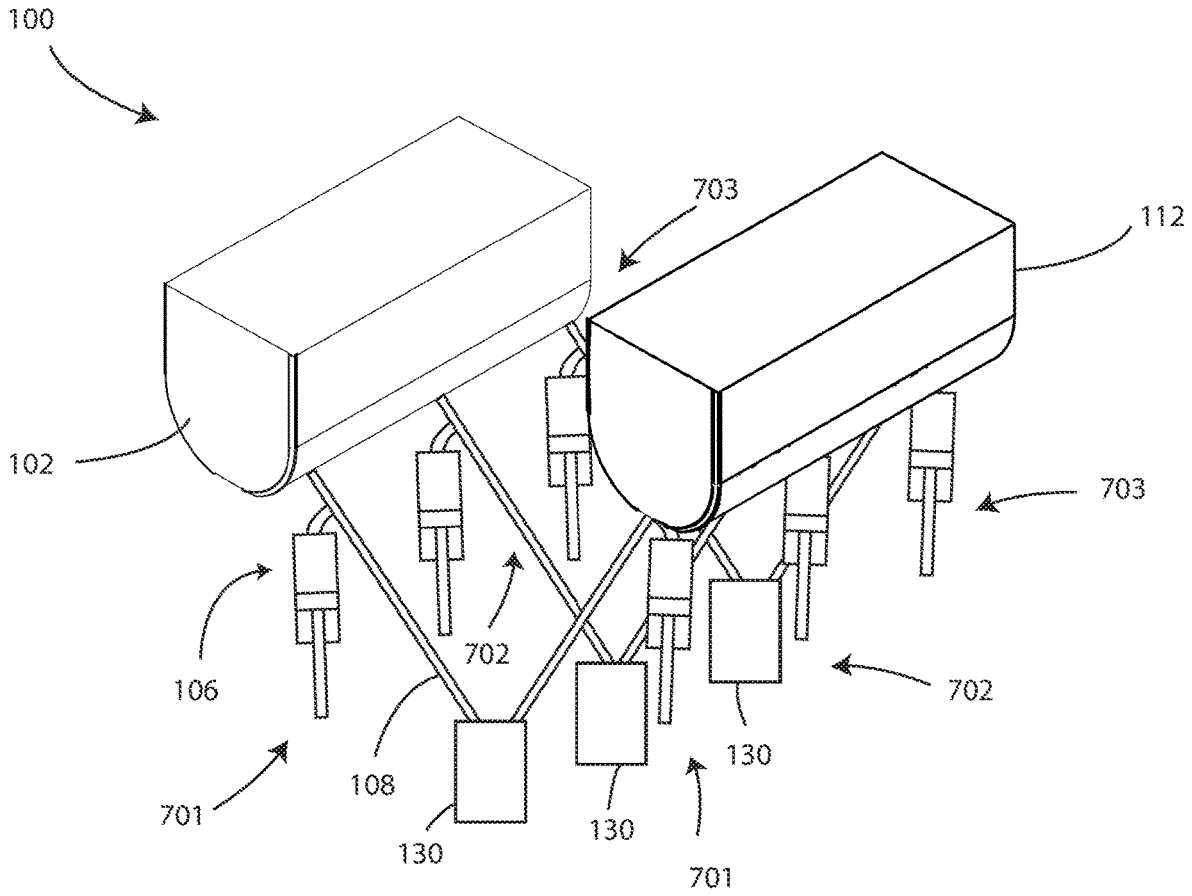
FIG. 10 is a partial schematic perspective view of a filling system in accordance with various embodiments herein.

Multiple filler mechanisms can be arrayed in parallel so as to increase the number of containers that can be filled in a given amount of time. Referring now to FIG. 10, a schematic partial perspective view is shown of a filling system 100 in accordance with various embodiments herein. The filling system 100 includes a first fluid reservoir. The first fluid reservoir 102 is in communication with a first line assembly 701, a second line assembly 702, and a third line assembly 703. The filling system 100 also includes a second fluid reservoir 112 in communication with a first line assembly 701, a second line assembly 702, and a third line assembly 703. Each line assembly includes a first pumping mechanism 106 and a first conduit 108. Each line assembly is in communication with a filler mechanism 130. The fluid reservoirs, pumping mechanisms, conduits, and fillers can be consistent with the various embodiments described herein. A filling system 100 provides the facility to fill multiple containers simultaneously to increase throughput.

While the various filling systems disclosed herein have been described with reference to combining and filling two phases, additional phases can be incorporated in filling systems consistent with the technology disclosed herein. For example, a filling system can include elements to combine a third fluid with a first fluid and a second fluid. In other examples, additional fluids can be included. The number of phases that can be combined and filled by the technology disclosed herein is not particularly limited. The elements required by a system to include additional phases are generally consistent with the elements described herein with reference to two-phase fillers.

Alternative Flow Control Configurations

The filling systems described herein can incorporate a variety of pumping mechanisms alternative to the in-line piston pumps described above for transferring fluid from a source to a downstream region. In some embodiments, a pumping mechanism includes a displacement pump that can be selectively engaged to provide a desired volume of fluid. A controller can be used to selectively engage and disengage the pump such that controlled volumes of fluid are provided by the pump. In some embodiments, a pumping mechanism can include a pump configured to run continuously. In such embodiments, fluid circuitry can be included to return fluid to the fluid source in overpressure conditions. In some embodiments having constantly-running pumps, a flow cutoff mechanism can be used to selectively open and close fluid communication between the pumping mechanism and a downstream conduit. Pumps used in a pumping mechanism can include positive displacement pumps including but not limited to gear pumps, screw pumps, progressing cavity pumps, roots pumps, peristaltic pumps, plunger pumps, and the like. Other possible pump types can include impulse pumps, radial-flow pumps, axial-flow pumps, mixed-flow pumps, educator-jet pumps, and the like.

In various embodiments, components such as pressurized hoppers, pressurized vessels, and pressurized pipes can be used instead of, or in addition to, various components of systems described herein. In some embodiments, components such as mass and/or batched flow meters can be used instead of, or in addition to, various components of systems described herein. In some embodiments, magnetic inductive dosing (MID) meters, electromechanical metering pumps, auger-style pumps, screw-type pumps and the like can be used instead of, or in addition to, various components of systems described herein.

One or more flow meters can be included in or used in conjunction with a pumping mechanism to accurately and precisely control the amount of fluid that is provided to downstream conduits of the filling system. In some embodiments, a flow meter is used in conjunction with a pumps and a controller to selectively engage and disengage the pump to provide a desired volume of fluid. Various flow meters can be used with the technology disclosed herein. For example, flow meters can include mechanical flow meters, pressure-based flow meters, optical flow meters, open-channel flow meters, thermal mass flow meters, vortex flow meters, sonar flow meters, electromagnetic flow meters, ultrasonic flow meters, Coriolis flow meters, laser Doppler flow meters, and the like.

In some embodiments, a flow cutoff mechanism is used to selectively open and close fluid communication between a source and a downstream conduit. A flow cutoff mechanism can be used in combination with a pump to selectively open and close fluid communication between the pumping mechanism and a downstream conduit. A flow cutoff mechanism can be used in combination with a flow meter to selectively open and close fluid communication between a source and a downstream conduit in response to an amount of fluid measured by the fluid flow meter. A flow cutoff mechanism can be incorporated with a flow meter. For example, certain mechanical flow meters can include selectable flow cutoff functionality and can be used for fluid metering, cutoff, or both. In some embodiments, a fluid source or reservoir provides a pressurized fluid. In such embodiments, a flow cutoff mechanism can be used to selectively allow fluid communication between the pressurized fluid source and a downstream conduit. A flow cutoff mechanism can include various types of valve for selectively allowing fluid communication.

Figure 13:
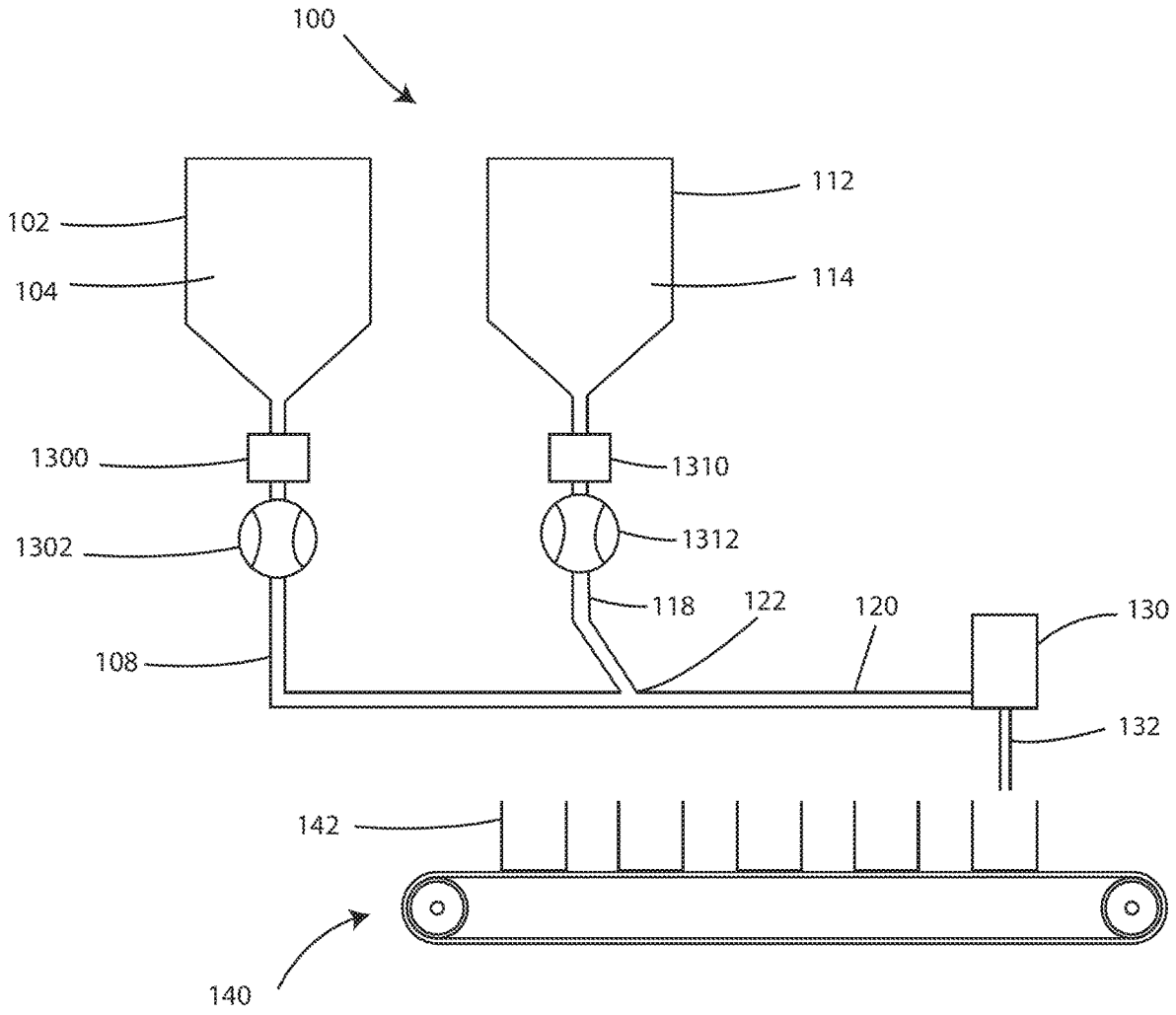
FIG. 13 is a schematic view of a filling system in accordance with various embodiments herein.

Referring now to FIG. 13, a schematic view is shown of a filling system 100 in accordance with various embodiments herein. The filling system 100 can be consistent with the filling system described above with reference to FIG. 1, but uses components in the alternative of pumping mechanisms. The filling system 100 is generally used to fill containers with a mixture of multiple fluid ingredients in a manner consistent with the various filling systems herein. As such, the filling system 100 includes a first reservoir 102 for providing a first fluid 104 and a second reservoir 112 for providing a second fluid 114. The first reservoir 102 and the second reservoir 104 can be consistent with the various fluid sources disclosed herein.

The filling system 100 a first flow cutoff mechanism 1300 for selectively allowing fluid communication between the first fluid source 102 and downstream regions of the filling system 100. The first flow cutoff mechanism 1300 can be controlled in response to measurements from a first flow meter 1302. The first flow meter 1302 is configured to measure the amount of fluid flow allowed by the first flow cutoff mechanism 1300. The filling system 100 a second flow cutoff mechanism 1310 for selectively allowing fluid communication between the second fluid source 112 and downstream regions of the filling system 100. The second flow cutoff mechanism 1310 can be controlled in response to measurements from a second flow meter 1312. The second flow meter 1312 is configured to measure the amount of fluid flow allowed by the second flow cutoff mechanism 1310. The first and second flow cutoff mechanisms 1300 and 1310 and the first and second flow meters 1302 and 1312 can be generally consistent with those described herein.

The filling system 100 generally includes a mixing region consistent with that described with reference to FIG. 1. As such, the filling system 100 include a manifold 120 for combining the first fluid 104 and the second fluid 114. The manifold 120 is generally in fluid communication with the first flow meter 1302, the first flow cutoff mechanism 1300, the second flow meter 1312, and the second flow cutoff mechanism 1310 by way of a first conduit 108 and a second conduit 118. The first conduit 108 and the second conduit 118 can each be connected to the manifold at a port 122.

The filling system 100 generally includes a filler mechanism 130 for dispensing discrete volumes of combined fluid into containers. The filler mechanism 130 can be generally consistent with the various filler mechanisms described herein. The filling system 100 can include a subsystem for providing containers to the filler mechanism 130 and conveying them to downstream processes. For example, the filling system 100 can include a conveying mechanism 140 for conveying one or more containers 142 into the vicinity of the filler mechanism 130. The conveying mechanism 142 and containers 142 for being conveyed thereon can be generally consistent with those described herein.

Fluid Compositions, Sources, and Filled Product

Various fluid sources that generally provide fluid to a filling system can be used with the technology disclosed herein. In some embodiments, the fluid sources include reservoirs. Reservoirs can include any structures for containing a volume of fluid to be processed by a filling system. In some embodiments, a reservoir contains a local accumulation of fluid in the direct environment of a filling system. In some embodiments, a reservoir contains a remote accumulation of fluid in an environment removed from the direct environment of a filling system. In some embodiments, a fluid source includes an access point to an upstream fluid system. For example, a fluid source can include an access port for providing heated water, the heated water being provided by a central water system. In some embodiments, a fluid source can include an access port for providing a slurry material, the slurry material being provided by an upstream system such as a centralized slurry generation system. In some embodiments, a fluid source or reservoir provides pressurized fluid. In some embodiments, a fluid source or reservoir provides fluid at an ambient hydrostatic pressure.

A reservoir of the filling systems disclosed herein can provide fluids having a variety of properties. In some embodiments, a reservoir (first, second, etc.) provides a fluid having a temperature within a range, wherein the upper and lower bounds of the range can be defined by any combination of the following temperatures: 100 degrees Fahrenheit, 110 degrees Fahrenheit, 120 degrees Fahrenheit, 130 degrees Fahrenheit, 140 degrees Fahrenheit, 150 degrees Fahrenheit, 160 degrees Fahrenheit, 170 degrees Fahrenheit, 180 degrees Fahrenheit, 185 degrees Fahrenheit, 190 degrees Fahrenheit, 200 degrees Fahrenheit, 205 degrees Fahrenheit, or 212 degrees Fahrenheit. In some embodiments, a reservoir provides a soup slurry at a temperature of at least 100 degrees Fahrenheit, or any of the other temperatures above or in a range between any of the temperatures above. In some embodiments, a reservoir provides a soup slurry at a temperature of at least 150 degrees Fahrenheit. In some embodiments, a reservoir provides water at a temperature of at least about 160 degrees Fahrenheit, or any of the temperatures above, or in a range between any of the temperatures above. In some embodiments, a reservoir provides water at a temperature between 100 and 200 degrees Fahrenheit. In various embodiments, systems herein can include heating elements, temperature controllers, thermometers, and the like in order to maintain fluids in certain portions of the system, such as the fluid reservoirs, at certain desired temperatures.

In some embodiments, a reservoir (first, second, etc.) provides a fluid having a density within a range, wherein the upper and lower bounds of the range can be defined by any combination of the following densities: 0.1 g/ml, 0.5 g/ml, 0.75 g/ml, 0.8 g/ml, 0.9 g/ml, 1.0 g/ml, 1.1 g/ml, 1.2 g/ml, 1.3 g/ml, 1.4 g/ml, 1.5 g/ml, 2.0 g/ml, or 2.5 g/ml. In some embodiments, a reservoir provides a fluid having a Bostwick consistency within a range, wherein the upper and lower bounds of the range can be defined by any combination of the following Bostwick consistencies: 0.5 cm, 1 cm, 2 cm, 3 cm, 4 cm, 5 cm, 6 cm, 7 cm, 8 cm, 9 cm, 10 cm, 15 cm, 20 cm, 25 cm, 30 cm, 35 cm, 40 cm, 45 cm, 50 cm, 55 cm, 60 cm, 65 cm, 70 cm, or 75 cm. Bostwick consistency can be measured in accordance with ASTM F1080-93.

The filling systems disclosed herein can process a variety of fluids to be filled in containers. In some embodiments, the first fluid is a concentrated material and the second fluid is a diluting agent. In some embodiments, at least one of the first or second fluid is a slurry. In some embodiments, at least one of the first or second fluid is water. In some embodiments, at least one of the first or second fluid is a food material. In some embodiments, the first fluid is a concentrated slurry comprising food material and the second fluid is water. In some embodiments, the first fluid is a concentrated slurry comprising food material and the second fluid is a liquid food material. A concentrated soup slurry can include a combination of a liquid base and a garnish comprising a solid material. A liquid soup base can include a broth or other water-based solution for use in soup. A soup garnish material can include meat, rice, noodles, vegetables, and other solid soup constituents. In some embodiments, the first fluid is a concentrated soup slurry comprising food material and the second fluid is a liquid soup base material. In some embodiments, a reservoir for providing a soup slurry includes an augur, mixer, or other blending structure for maintaining a uniform slurry composition and preventing solids from settling and or stratifying within the reservoir.

Figure 11:
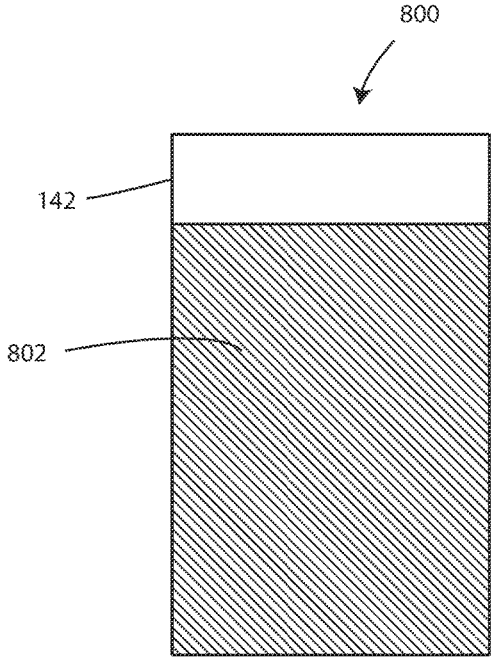
FIG. 11 is a schematic side view of a soup container in accordance with various embodiments herein.

The filling systems disclosed herein can fill containers with a combination of a first fluid and a second fluid. The filled fluid combinations provided by the systems herein can be mixed. In some embodiments, the filled fluid is well mixed such that the mixture is free of regions of unmixed fluid. In some embodiments, a container having been filled by the system contains a mixture that is free of discrete layers of unmixed fluid. FIG. 11 illustrates a container 142 that is filled with a well-mixed filled material 800. The filled material 800 comprises a liquid base 802. The liquid base 802 is uniform in composition throughout the entirety of the filled material 800. For example, the liquid base 802 can be a liquid with a substantially uniform concentration of solute at any given point within the container 142. In some embodiments, a solid material (not shown) is present in the filled material 800. In some embodiments, the liquid material 802 is a soup base and includes water and dissolved solids. In some embodiments, a solid material present in a container is a soup garnish material.

Figure 12:
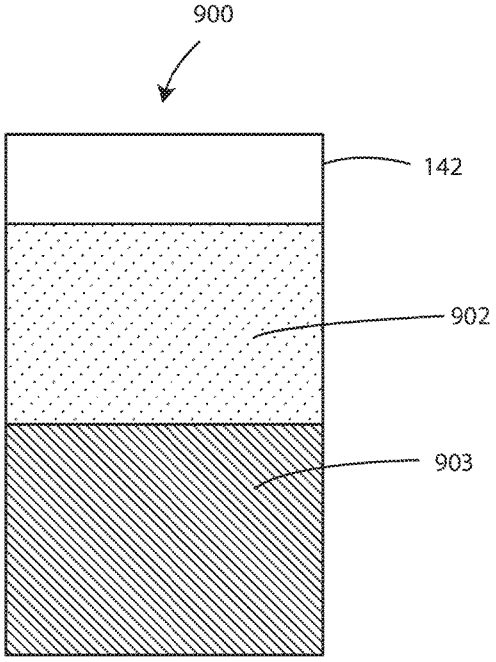
FIG. 12 is a schematic side view of a soup container in accordance with various embodiments herein.

FIG. 12 illustrates a container 142 that is filled with a poorly-mixed filled material 900. The filled material 900 is stratified and includes a layer of substantially-unmixed first fluid 902 and substantially-unmixed second fluid 903 (e.g. a distinct first phase and a distinct second phase). The first fluid 902 can include a liquid base with a low concentration of dissolved solids. The second fluid 903 can include a slurry material, the slurry material including a liquid base having a concentration of dissolved solids that is greater than the concentration of dissolved solids of the first fluid 902. In some embodiments, the first fluid 902 includes a dilute soup base material and the second fluid 903 includes a concentrated soup base material.

The mixed fluid material provided by the filling systems herein can have a variety of properties. In some embodiments, a filling system provides a mixed fluid having a density within a range, wherein the upper and lower bounds of the range can be defined by any combination of the following densities: 0.8 g/ml, 0.9 g/ml, 1.0 g/ml, 1.1 g/ml, 1.2 g/ml, 1.3 g/ml, 1.4 g/ml, 1.5 g/ml, 2.0 g/ml, or 2.5 g/ml. In some embodiments the soup slurry or concentrate can have a density of at least about 1.1 g/ml, 1.2 g/ml, 1.3 g/ml, 1.4 g/ml, 1.5 g/ml, 2.0 g/ml, or 2.5 g/ml. In some embodiments, the aqueous diluting solution can have a density of less than or equal to about 1.1 g/ml or 1.0 g/ml.

In some embodiments, a filling system provides a mixed fluid having a Bostwick consistency within a range, wherein the upper and lower bounds of the range can be defined by any combination of the following Bostwick consistencies: 0.5 cm, 1 cm, 2 cm, 3 cm, 4 cm, 5 cm, 6 cm, 7 cm, 8 cm, 9 cm, 10 cm, 15 cm, 20 cm, 25 cm, 30 cm, 35 cm, 40 cm, 45 cm, 50 cm, 55 cm, 60 cm, 65 cm, 70 cm, or 75 cm. In some embodiments, the soup concentrate or soup slurry can have a Bostwick consistency of about 5, 7.5, 10, 12.5 or 15 cm, or in a range between any two of the foregoing.

The concentrated soup product or slurry can have a substantially different amount of dissolved solids than the diluting solution, which can be water or another aqueous solution. In some embodiments, the concentrated soup product can include at least about 10, 14, 18, 22, 26, 30, 34, 38, 42, 46, 50, 54, 58 or more percent dissolved solids by weight (wherein the amount of dissolved solids is expressed as a percentage of the total solution weight). In some embodiments, the aqueous diluting solution can include less than or equal to about 10, 8, 7, 6, 5, 4, 3, 2, 1, 0.5, or 0.1 percent dissolved solids by weight. In some embodiments, the difference in percent dissolved solids between one fluid and the other fluid that are mixed can be at least about 2, 4, 6, 8, 10, 15, 20, 25, 30, 35, 40, 45, or 50.

Process Parameters

The filling systems disclosed herein can be used to fill containers with a variety of fluid volumes or weights. A filling system can be constructed to provide a fixed volume or weight of fluid to a container. A filling system can be constructed to provide an adjustable volumes or weight of fluid to a container. In some embodiments, the filling system can provide a container with a fluid having a volume within a range, wherein the upper and lower bounds of the range can be defined by any combination of the following volumes: 1 ml, 5 ml, 10 ml, 20 ml, 30 ml, 50 ml, 100 ml, 200 ml, 250 ml, 500 ml, 750 ml, 1000 ml, 1500 ml, 2000 ml, or 5000 ml. In some embodiments, the filling system can provide a container with a fluid having a mass within a range, wherein the upper and lower bounds of the range can be defined by any combination of the following masses: 10 g, 20 g, 50 g, 100 g, 150 g, 200 g, 250 g, 300 g, 350 g, 400 g, 450 g, 500 g, 550 g, 600 g, 650 g, 700 g, 750 g, 800 g, 850 g, 900 g, 950 g, or 1000 g. In some embodiments, the filling system can provide a container with a fluid having a mass within a range, wherein the upper and lower bounds of the range can be defined by any combination of the following masses: 1 ounce, 2 ounces, 4 ounces, 6 ounces, 8 ounces, 10 ounces, 12 ounces, 14 ounces, 15 ounces, 16 ounces, 18 ounces, 20 ounces, 22 ounces, 24 ounces, 26 ounces, 28 ounces, 30 ounces, 32 ounces, 34 ounces, 36 ounces, and greater than 36 ounces. Total throughput for the filling system can vary from about 225 ounces per minute or less to about 5,440 ounces per minute or more.

The filling systems disclosed herein can be used to fill containers with a combination of fluids at a variety or ratios. A filling system can be constructed to provide a fixed ratio of a first fluid and a second fluid to a container. A filling system can be constructed to provide an adjustable ratio of a first fluid and a second fluid to a container. In some embodiments, the filling system can provide a container with a fluid comprising a combination of a first fluid and a second fluid at a volumetric ratio of first fluid to second fluid within a range, wherein the upper and lower bounds of the range can be defined by any combination of the following ratios: 5:95, 10:90, 20:80, 30:70, 40:60, 50:50, 60:40, 70:30, 20:80, 10:90, or 5:95. In some embodiments, the filling system can provide a container with a fluid comprising a combination of a first fluid and a second fluid at a mass ratio of first fluid to second fluid within a range, wherein the upper and lower bounds of the range can be defined by any combination of the following ratios: 5:95, 10:90, 20:80, 30:70, 40:60, 50:50, 60:40, 70:30, 20:80, 10:90, or 5:95.

The displacement of each pumping mechanism can determine the volume of fluid filled by a filing mechanism and the ratio of the constituent fluids thereof. In some embodiments, a first piston pump has a displacement such that with each cycle the piston pump provides a volume of fluid within a range, wherein the upper and lower bounds of the range can be defined by any combination of the following volumes: 1 ml, 5 ml, 10 ml, 20 ml, 30 ml, 50 ml, 100 ml, 200 ml, 250 ml, 500 ml, 750 ml, 1000 ml, 1500 ml, 2000 ml, or 5000 ml. In some embodiments, a second piston pump has a displacement such that with each cycle the piston pump provides a volume of fluid within a range, wherein the upper and lower bounds of the range can be defined by any combination of the following volumes: 1 ml, 5 ml, 10 ml, 20 ml, 30 ml, 50 ml, 100 ml, 200 ml, 250 ml, 500 ml, 750 ml, 1000 ml, 1500 ml, 2000 ml, or 5000 ml. In some embodiments, a first piston pump has a displacement such that with each cycle the piston pump provides a mass of fluid within a range, wherein the upper and lower bounds of the range can be defined by any combination of the following volumes: 10 g, 20 g, 50 g, 100 g, 150 g, 200 g, 250 g, 300 g, 350 g, 400 g, 450 g, 500 g, 550 g, 600 g, 650 g, 700 g, 750 g, 800 g, 850 g, 900 g, 950 g, or 1000 g. In some embodiments, a second piston pump has a displacement such that with each cycle the piston pump provides a mass of fluid within a range, wherein the upper and lower bounds of the range can be defined by any combination of the following volumes: 10 g, 20 g, 50 g, 100 g, 150 g, 200 g, 250 g, 300 g, 350 g, 400 g, 450 g, 500 g, 550 g, 600 g, 650 g, 700 g, 750 g, 800 g, 850 g, 900 g, 950 g, or 1000 g.

Containers and Throughput Rate

A filling system can be configured to process fluid at a certain volumetric throughput rate. In some embodiments, the filling system has a volumetric throughput rate within a range, wherein the upper and lower bounds of the range can be defined by any combination of the following throughput rates: 1 LPM (liter per minute), 2 LPM, 3 LPM, 4 LPM, 5 LPM, 10 LPM, 15 LPM, 20 LPM, 25 LPM, 30 LPM, 35 LPM, 40 LPM, 50 LPM, 60 LPM, 70 LPM, 80 LPM, 90 LPM, 100 LPM, 115 LPM, 130 LPM, 145 LPM, 160 LPM, 175 LPM, 200 LPM, 300 LPM, 400 LPM, 500 LPM, 750 LPM, 1000 LPM, or 1500 LPM.

A filling system can be configured to fill containers with fluid at a certain throughput rate. In some embodiments, a filling system has a throughput rate within a range, wherein the upper and lower bounds of the range can be defined by any combination of the following throughput rates: 1 containers per minute, 5 containers per minute, 10 containers per minute, 20 containers per minute, 25 containers per minute, 50 containers per minute, 75 containers per minute, 100 containers per minute, 150 containers per minute, 160 containers per minute, 170 containers per minute, 180 containers per minute, 190 containers per minute, 200 containers per minute, 300 containers per minute, 400 containers per minute, 500 containers per minute, 750 containers per minute, or 1000 containers per minute.

A variety of container types can be filled by the filling systems disclosed herein. In some embodiments, the containers are soup cups. In some embodiments, the containers are beverage bottles. In some embodiments, the containers are other fluidic food containers. The containers can be constructed of a polymer, a glass, a ceramic, a metal, an organic material, and the like. In some embodiments, the containers have at least one translucent region through which the contained fluid can be viewed. In some embodiments, the containers are labeled soup containers with a viewing window.

The embodiments described herein are not intended to be exhaustive or to limit the invention to the precise forms disclosed in the following detailed description. Rather, the embodiments are chosen and described so that others skilled in the art can appreciate and understand the principles and practices. Therefore, it should be understood that many variations and modifications may be made while remaining within the spirit and scope herein.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

The invention claimed is:

1. A piston filling apparatus for food products comprising:

a first supply reservoir;

a first piston pump in fluid communication with the first supply reservoir;

a first fluid supply conduit in fluid communication with the first piston pump;

the first piston pump comprising a piston that moves in cycle including a filling stroke where movement of the piston draws a fluid in from the first supply reservoir and an expelling stroke where movement of the piston expels the fluid into the first fluid supply conduit;

a second supply reservoir;

a second piston pump in fluid communication with the second supply reservoir;

a second fluid supply conduit in fluid communication with the second piston pump;

the second piston pump comprising a piston that moves in cycle including a filling stroke where movement of the piston draws a fluid in from the second supply reservoir and an expelling stroke where movement of the piston expels the fluid into the second fluid supply conduit;

a fluid manifold in fluid communication with the first fluid supply conduit and the second fluid supply conduit;

a piston valve in fluid communication with the fluid manifold;

a dispensing nozzle in fluid communication with the piston valve;

the piston valve comprising a piston that moves in cycle including an opening stroke where movement of the piston allows a fluid to flow in from the fluid manifold and a closing stroke where movement of the piston expels the fluid out through the dispensing nozzle;

a controller configured to control operations of the first piston pump, the second piston pump, and the piston valve, the controller configured to synchronize operation of the first piston pump, the second piston pump, and the piston valve such that the expelling stroke of the first piston pump is synchronized with the expelling stroke of the second piston pump, and the expelling stokes of the first and second piston pumps are synchronized with the opening stroke of the piston valve; and wherein the opening stroke of the piston valve draws a volume of fluid that is equal to the cumulative volume of fluid discharged during the expelling stroke of the first piston pump and the expelling stroke of the second piston pump.

2. The piston filling apparatus for food products of claim 1, the controller configured to synchronize the end of the expelling stroke of the first piston pump with the end of the expelling stroke of the second piston pump.

3. The piston filling apparatus for food products of claim 1, the first supply reservoir comprising water at a temperature of at least about 160 degrees Fahrenheit.

4. The piston filling apparatus for food products of claim 1, the first supply reservoir comprising water at a temperature of 100 to 200 degrees Fahrenheit.

5. The piston filling apparatus for food products of claim 1, the second supply reservoir comprising a soup slurry at a temperature of at least about 100 degrees Fahrenheit.

6. The piston filling apparatus for food products of claim 1, the second supply reservoir comprising a soup slurry having a density of at least about 1.1 g/ml.

7. The piston filling apparatus for food products of claim 1, the second supply reservoir comprising a soup slurry having a Bostwick consistency of at least about 5 cm.

8. The piston filling apparatus for food products of claim 1, wherein the fluid expelled from the dispensing nozzle is a mixture of the fluid from the first supply reservoir and the fluid from the second supply reservoir that is free of discrete layers of unmixed fluid.

9. A method for filling a container with a food product comprising:

pumping a volume of first fluid from a first reservoir into a first conduit using a first piston pump, comprising:

drawing a volume of first fluid from the first reservoir in an intake stroke of a first piston, and expelling a volume of first fluid into the first conduit in an exhaust stroke of the first piston;

pumping a volume of second fluid from a second reservoir into a second conduit using a second piston pump, comprising:

drawing a volume of second fluid from the second reservoir in an intake stroke of a second piston, and expelling a volume of second fluid into the second conduit in an exhaust stroke of the second piston, wherein the exhaust stroke of the second piston occurs in synchrony with the exhaust stroke of the first piston;

combining the first fluid with the second fluid in a manifold, the manifold comprising a fluid junction between the first supply conduit and the second supply conduit;

allowing the combined first fluid and second fluid to flow through a nozzle by opening a piston valve, the nozzle providing the combined first fluid and second fluid to a container; wherein opening the piston valve occurs in synchrony with the exhaust stroke of the first piston and the exhaust stroke of the second piston; and drawing a volume of fluid that is equal to the cumulative volume of fluid discharged during the expelling stroke of the first piston pump and the expelling stroke of the second piston pump during an opening stroke of the piston valve.

10. The method for filling a container with a food product of claim 9, wherein the first piston reaches a top dead center position following each exhaust stroke at the same time as the second piston reaches a top dead center position following each exhaust stroke.

11. The method for filling a container with a food product of claim 9, the second reservoir comprising a water at a temperature of at least about 160 degrees Fahrenheit.

12. The method for filling a container with a food product of claim 9, the second reservoir comprising water at a temperature of 100 to 200 degrees Fahrenheit.

13. The method for filling a container with a food product of claim 9, the first reservoir comprising a soup slurry at a temperature of at least about 100 degrees Fahrenheit.

14. The method for filling a container with a food product of claim 9, the first reservoir comprising a soup slurry having a density of at least about 1.1 g/ml.

15. The method for filling a container with a food product of claim 9, the first reservoir comprising a soup slurry having a Bostwick consistency of at least about 5 cm.

16. The method for filling a container with a food product of claim 9, wherein the combined first fluid and second fluid provided by the nozzle is mixed and free of discrete layers of first fluid or second fluid.

17. An apparatus for filling a container with a food product comprising:

a slurry pump configured to draw a volume of slurry into a first cylinder and discharge the volume of slurry into a mixing conduit using a first piston;

a water pump configured to draw a volume of water into a second cylinder and discharge the volume of water into a water feed conduit using a second piston;

a port in the mixing conduit downstream from the slurry pump configured to receive water from the water feed conduit;

a filler assembly downstream from the port, the filler assembly comprising: a chamber, a filler piston configured to allow a mixture of slurry and water from the mixing conduit into the chamber and further configured to allow a mixture of slurry and water to flow out of the chamber, and a nozzle configured to fill a container with a mixture of water and slurry from the chamber; and a controller configured to control operations of the slurry pump and the water pump, the controller configured to synchronize operation of the slurry pump and the water pump such that the discharging of the volume of slurry into the mixing conduit is synchronized with the discharging of the volume of water into the water feed conduit; wherein a displacement of the filler piston is equal to the combined displacements of the slurry pump and the water pump.

18. The apparatus for filling a container with a food product of claim 17, wherein the water drawn into the second cylinder is at a temperature of at least about 160 degrees Fahrenheit.

19. The apparatus for filling a container with a food product of claim 17, wherein the water drawn into the second cylinder is at a temperature of 100 to 200 degrees Fahrenheit.

20. The apparatus for filling a container with a food product of claim 17, wherein the slurry drawn into the first cylinder has a density of at least about 1.1 g/ml.

21. The apparatus for filling a container with a food product of claim 17, wherein the slurry drawn into the first cylinder has a Bostwick consistency of at least about 5 cm.

22. The apparatus for filling a container with a food product of claim 17, wherein the slurry drawn into the first cylinder is at a temperature of at least about 100 degrees Fahrenheit.

23. The apparatus for filling a container with a food product of claim 17, wherein the combined slurry and water filled by the nozzle is mixed and free of discrete layers of slurry and water.

* * * * *